US009114648B2

(12) United States Patent
Tamaki

(10) Patent No.: US 9,114,648 B2
(45) **Date of Patent: *Aug. 25, 2015**

(54) INK-JET RECORDING APPARATUS

(75) Inventor: Shuichi Tamaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/609,137

(22) Filed: Sep. 10, 2012

(65) Prior Publication Data

US 2013/0063513 A1 Mar. 14, 2013

Related U.S. Application Data

(62) Division of application No. 12/625,545, filed on Nov. 24, 2009, now Pat. No. 8,277,014.

(30) Foreign Application Priority Data

Dec. 24, 2008 (JP) ..... 2008-327660

(51) Int. Cl.
*B41J 29/38* (2006.01)
*B41J 29/393* (2006.01)
*B41J 11/00* (2006.01)

(52) U.S. Cl.
CPC ..... *B41J 29/38* (2013.01); *B41J 11/006* (2013.01); *B41J 11/007* (2013.01)

(58) Field of Classification Search
USPC ..... 347/8–9, 4, 14, 16, 19
See application file for complete search history.

(56) References Cited

U.S. PATENT DOCUMENTS 7,252,363 B2 8/2007 Takagi et al.
7,334,859 B2 2/2008 Kojima
(Continued)

FOREIGN PATENT DOCUMENTS

EP 1790487 A1 5/2007
JP H11-084783 A 3/1999
(Continued)

OTHER PUBLICATIONS

Japan Patent Office, Notification of Reason(s) for Refusal for Japanese Patent Application No. 2008-327660 (counterpart to co-pending U.S. Appl. No. 12/625,545), dispatched Dec. 7, 2010.
(Continued)

*Primary Examiner* — Jason Uhlenhake
(74) *Attorney, Agent, or Firm* — Baker Botts L.L.P.

(57) ABSTRACT

A liquid ejection apparatus includes a liquid ejection head, a conveyor, a recording controller, and a flashing controller. The conveyor conveys a recording medium along a conveyance path. The recording controller causes the conveyor to convey a recording medium, and controls liquid ejection from the liquid ejection head to form an image on the recording medium based on image data. The flashing controller causes the conveyor to temporarily stop conveyance of the recording medium, and causes liquid ejection from the liquid ejection head based on drive data which is unrelated to image formation. The flashing controller determines timing for executing a subsequent flashing control so that, within a print enforceable period between one flashing control and the subsequent flashing control, the number of pages subjected to image formation based on image data increases with a decrease in time interval between image formation on one page and on another page.

12 Claims, 12 Drawing Sheets

(56) References Cited

U.S. PATENT DOCUMENTS

| | | | | |
|---|---|---|---|---|
| 7,594,709 | B2 * | 9/2009 | Kojima | 347/19 |
| 7,841,683 | B2 | 11/2010 | Miyazawa | |
| 8,277,014 | B2 * | 10/2012 | Tamaki | 347/16 |
| 2004/0075708 | A1 * | 4/2004 | Arakawa | 347/19 |
| 2005/0046658 | A1 | 3/2005 | Kojima | |
| 2005/0062793 | A1 | 3/2005 | Takagi et al. | |
| 2006/0181556 | A1 * | 8/2006 | Wanibuchi et al. | 347/8 |
| 2007/0035605 | A1 * | 2/2007 | Kitahara | 347/104 |
| 2008/0106565 | A1 * | 5/2008 | Miyazawa | 347/16 |
| 2008/0298821 | A1 * | 12/2008 | Mori | 399/21 |
| 2009/0189967 | A1 * | 7/2009 | Sakano | 347/104 |

FOREIGN PATENT DOCUMENTS

| | | | |
|---|---|---|---|
| JP | 2002-113910 | A | 4/2002 |
| JP | 2002-189398 | A | 7/2002 |
| JP | 2005-096187 | A | 4/2005 |
| JP | 2005-111939 | A | 4/2005 |
| JP | 2006-011146 | A | 1/2006 |
| JP | 2006-205742 | A | 8/2006 |
| JP | 2006-264074 | A | 10/2006 |
| JP | 2006264074 | A * | 10/2006 |
| JP | 2007-144633 | A | 6/2007 |
| JP | 2008-137811 | A | 6/2008 |
| WO | 2006/054665 | A1 | 5/2006 |

OTHER PUBLICATIONS

Japan Patent Office, Notification of Reason(s) for Refusal for Japanese Patent Application No. 2011-023709 (counterpart to co-pending U.S. Appl. No. 12/625,545), dispatched May 10, 2011.

Japan Patent Office, Decision of Refusal for Japanese Patent Application No. 2011-023709 (counterpart to co-pending U.S. Appl. No. 12/625,545), dispatched Sep. 13, 2011.

* cited by examiner

INK-JET RECORDING APPARATUS

CROSS REFERENCE TO RELATED APPLICATION

The application is a divisional application of U.S. patent application Ser. No. 12/625,545, filed on Nov. 24, 2009, which claims the benefit of Japanese Patent Application No. 2008-327660, which was filed on Dec. 24, 2008, the disclosures of which are herein incorporated by reference in their entirety.

BACKGROUND OF THE INVENTION

1. Field of the Invention

The present invention relates to an ink-jet recording apparatus configured to conduct recording on a recording medium.

2. Discussion of Related Art

In a recording apparatus such as an ink-jet printer, a jam of a recording medium such as paper sometimes occurs when the recording medium is being conveyed between an ink-jet head for ejecting ink on the recording medium and a conveyor mechanism for conveying the recording medium.

In the light of the above, there is disclosed an apparatus in which the conveyor mechanism is configured to be moved away from the ink-jet head when the jam of the recording medium occurs, thereby ensuring a user easy removal of the jammed recording medium.

SUMMARY OF THE INVENTION

According to the arrangement described above, whether a jam-clearing processing for removing a jammed recording medium is conducted or not is up to a user, and the user sometimes does not conduct the jam-clearing processing. Further, even when the user has conducted the jam-clearing processing, there may be an instance in which a part of the jammed recording medium remains between the ink-jet head and the conveyor mechanism without being completely removed. In such an instance, if the conveyor mechanism which has been located away from the ink-jet head is moved near to the ink-jet head, the jammed recording medium remaining between the ink-jet head and the conveyor mechanism may come into contact with the ink-jet head, resulting in damage to the ink-jet head.

It is therefore an object of the invention to provide an ink-jet recording apparatus capable of preventing an ink-jet head from being damaged by a jammed recording medium.

The above-indicated object may be attained according to a principle of the invention, which provides an ink-jet recording apparatus, comprising:

an ink-jet head in which is formed an ejection surface from which ink is ejected;

a conveyor mechanism which has a conveyor surface opposed to the ejection surface and which is configured to convey a recording medium placed on the conveyor surface, in a medium conveyance direction;

a relative movement mechanism configured to move at least one of the conveyor mechanism and the ink-jet head relative to each other such that the conveyor mechanism and the ink-jet head are located selectively at one of: a recording position at which an image is recorded on the recording medium with the ink ejected from the ink-jet head; and a medium removal position at which a distance between the ejection surface and the conveyor mechanism is larger than that when the conveyor mechanism and the ink-jet head are located at the recording position and at which a jammed recording medium jammed between the ejection surface and the conveyor mechanism is allowed to be removed by a user;

a detecting device configured to detect an occurrence of a jam of the recording medium between the ink-jet head and the conveyor mechanism;

an output device configured to output a jam-clearing completion signal indicative of completion of a jam-clearing processing for clearing the jam of the recording medium, in response to a prescribed operation by a user;

a sensor for detecting the recording medium existing between the ink-jet head and the conveyor mechanism; and a relative-movement control device configured to control the relative movement mechanism and including (a) a first control portion configured to control the relative movement mechanism such that the relative movement mechanism conducts a first operation in which said at least one of the conveyor mechanism and the ink-jet head is moved relative to each other such that the conveyor mechanism and the ink-jet head are located at the medium removal position from the recording position when the detecting device detects the occurrence of the jam of the recording medium and such that the relative movement mechanism conducts, after the first operation, a second operation in which said at least one of the conveyor mechanism and the ink-jet head is moved relative to each other such that the conveyor mechanism and the ink-jet head are located at the recording position from the medium removal position when the output device outputs the jam-clearing completion signal and (b) a second control portion configured to control the relative movement mechanism to prevent the conveyor mechanism and the ink-jet head from moving relatively toward each other where the sensor detects the recording medium in the second operation.

It is noted that "to move at least one of the ink-jet head and the conveyor mechanism relative to each other" means that only one of the ink-jet head and the conveyor mechanism is moved by the relative movement mechanism or both of the ink-jet head and the conveyor mechanism are moved relative to each other by the relative movement mechanism.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

There will be hereinafter described preferred embodiments of the invention with reference to the drawings.

1. First Embodiment

<Mechanical Structure of Ink-Jet Printer>

Figure 1:
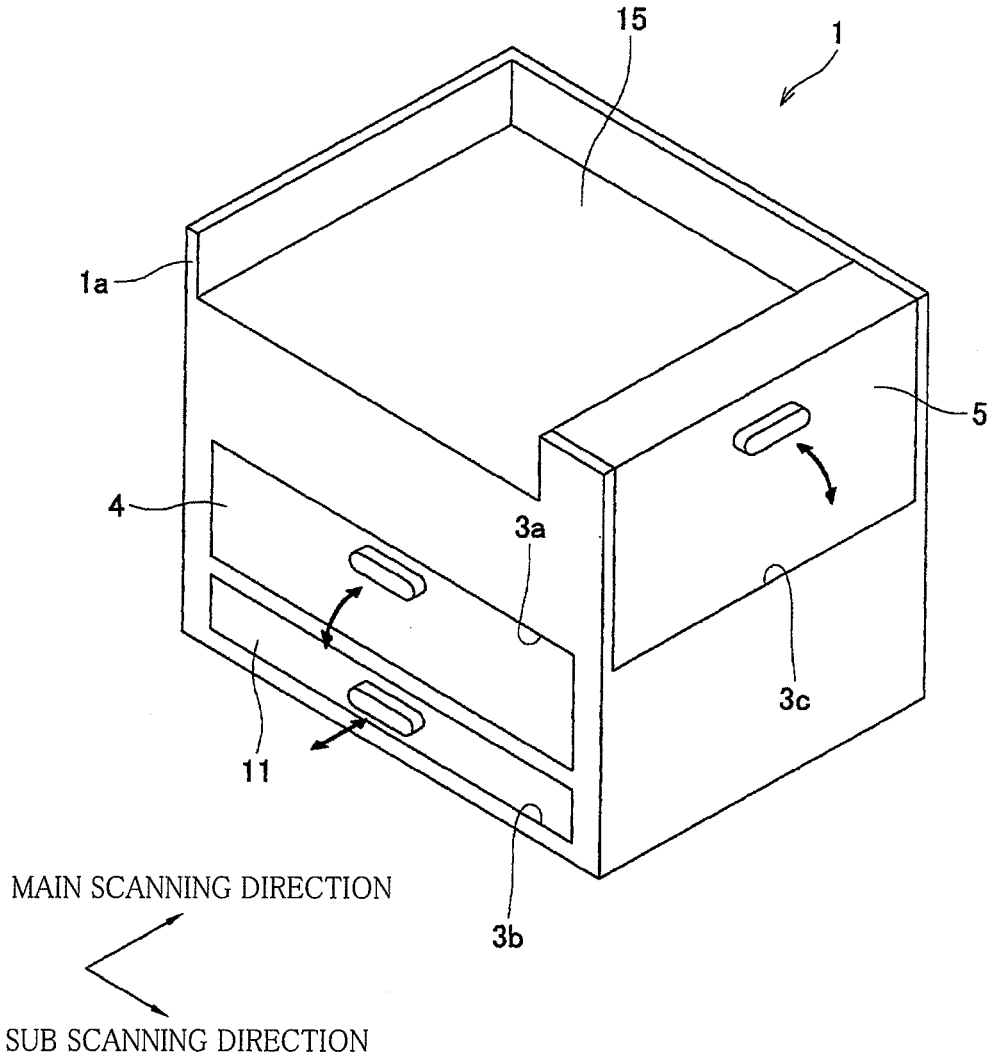
FIG. 1 is a perspective external view of an ink-jet printer according to a first embodiment of the invention.

As shown in the perspective view of FIG. 1, an ink-jet printer 1 as an ink-jet recording apparatus has a casing 1*a* which is a rectangular parallelepiped and which has two openings, i.e., upper and lower openings 3*a*, 3*b*, that are formed on the front of the casing 1*a* (on the front surface of the casing 1*a* in FIG. 1). In the opening 3*a*, a first door 4 is provided so as to be openable and closable about a horizontal axis located at the lower end of the opening 3*a*. The opening 3*a* and the first door 4 are disposed so as to be opposed to a conveyor mechanism 50 (a conveyor portion) in a depth direction of the casing 1, namely, in a direction perpendicular to the plane of FIG. 2, i.e., in a main scanning direction. The arrangement allows a user easy access to the conveyor mechanism 50 by opening the first door 4 in an instance where a sheet P (as a recording medium) is jammed in the conveyor mechanism 50, so that the jammed sheet P can be removed.

Figure 2:
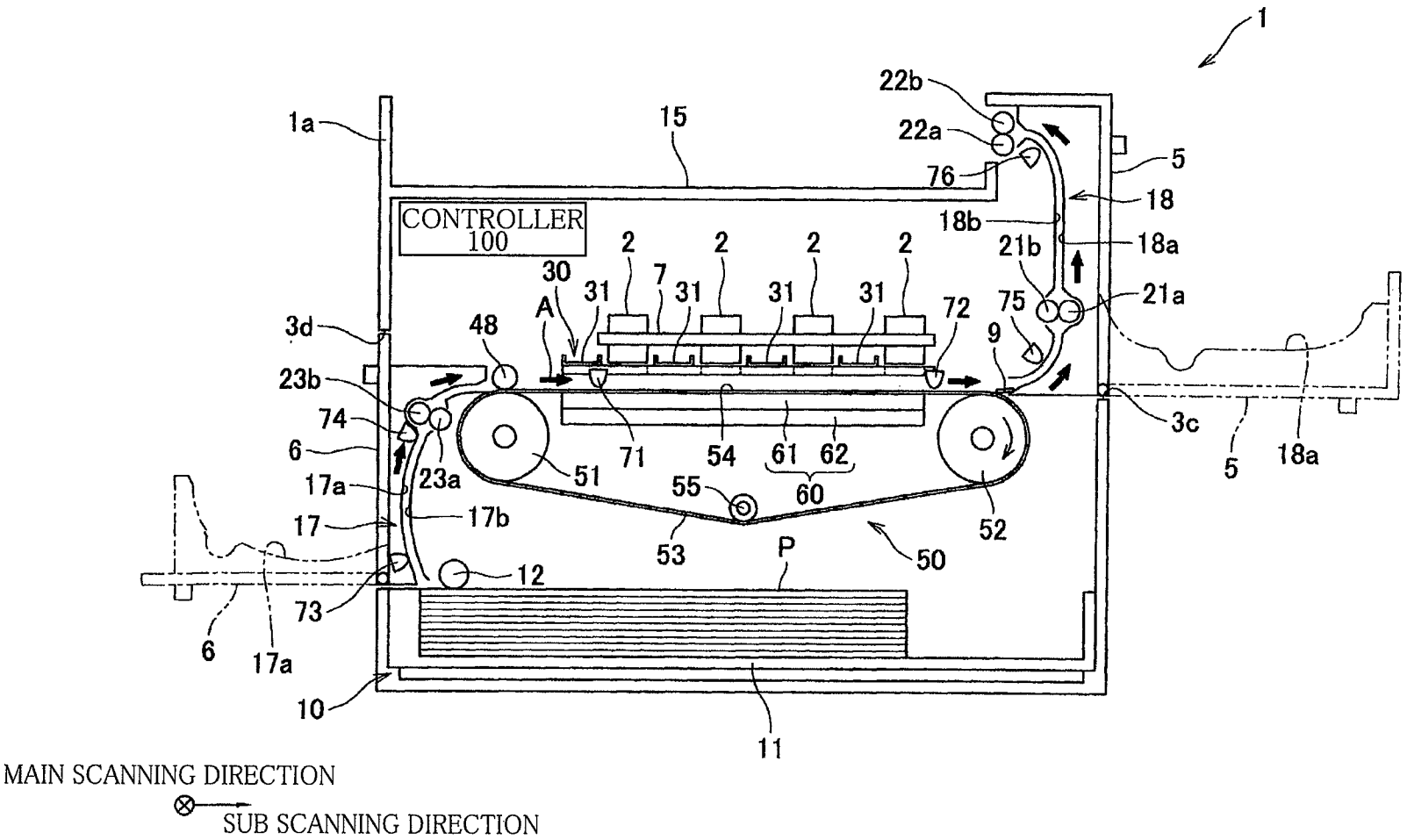
FIG. 2 is a schematic side view showing an internal structure of the ink-jet printer of FIG. 1.

As shown in FIG. 1, an opening 3*c* is formed on one side surface of the casing 1*a* (on the right side surface of the casing 1*a* in FIG. 1). In the opening 3*c*, a third door 5 is provided so as to be openable and closable about a horizontal axis located at the lower end of the opening 3*c*. As shown in FIG. 2, on the inner side of the third door 5, an outer guide surface 18*a* that partially constitutes a sheet guide 18 (which will be described) is formed. The opening 3*c* and the third door 5 are disposed so as to be opposed to an inside of the sheet guide 18 in a sub scanning direction that is perpendicular to the main scanning direction. In this structure, where the sheet P is jammed in the sheet guide 18, the user can access the inside of the sheet guide 18 by opening the third door 5, so that the jammed sheet P can be removed.

An opening 3*d* (not shown) is formed on another side surface of the casing 1 (on the left side surface of the casing 1*a* in FIG. 1). In the opening 3*d*, a second door 6 is provided so as to be openable and closable about a horizontal axis located at the lower end of the opening 3*d*. As shown in FIG. 2, on the inner side of the second door 6, an outer guide surface 17*a* that partially constitutes a sheet guide 17 (which will be described) is formed. The opening 3*d* and the second door 6 are disposed so as to be opposed to an inside of the sheet guide 17 in the sub scanning direction. In this structure, where the sheet P is jammed in the sheet guide 17, the user can access the inside of the sheet guide 17 by opening the second door 6, so that the jammed sheet P can be removed.

The ink-jet printer 1 is a color ink-jet printer having four ink-jet heads 2 which respectively eject inks of different colors, i.e., magenta, cyan, yellow, and black. The ink-jet printer 1 has a sheet supply device 10 at its lower portion and a discharged-sheet receiving portion 15 at its upper portion. The conveyor mechanism 50 for conveying the sheet P in a sheet conveyance direction A is disposed between the sheet supply device 10 and the discharged-sheet receiving portion 15. The ink-jet printer 1 further has a controller 100 for controlling operations thereof.

Each of the four ink-jet heads 2 has a generally rectangular parallelepiped shape that is long in the main scanning direction. The four ink-jet heads 2 are disposed so as to be spaced apart from each other in the sub scanning direction and are fixed to a frame 7. That is, the ink-jet printer 1 is a line-type printer. In the present embodiment, the sub scanning direction is a direction parallel to the sheet conveyance direction A while the main scanning direction is a direction perpendicular to the sub scanning direction and is horizontal, namely, the main scanning direction coincides with the vertical direction in FIG. 3.

Figure 3:
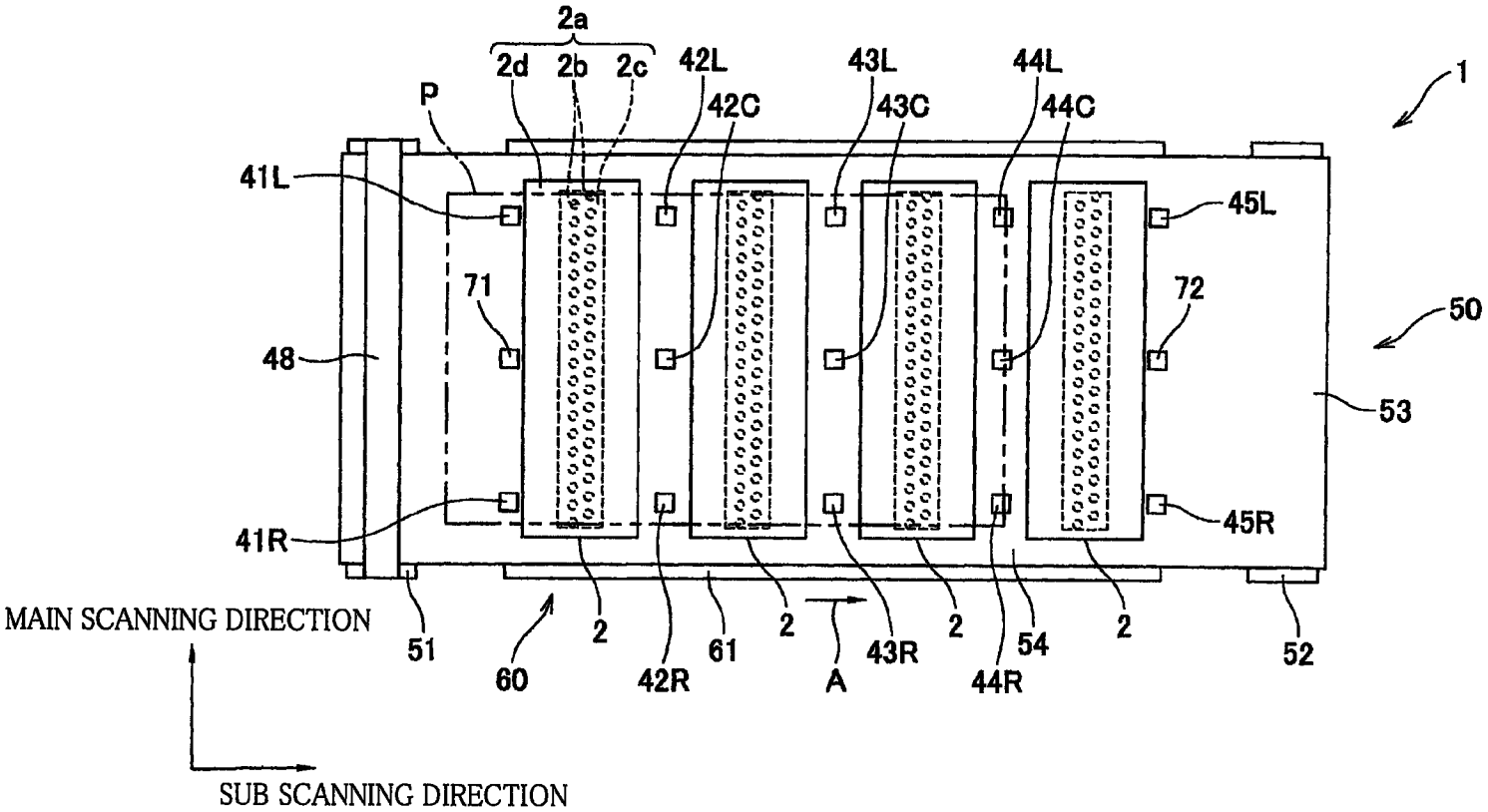
FIG. 3 is a plan view of four ink-jet heads of FIG. 2 and the vicinity thereof when viewed from the above.

Each ink-jet head 2 has a laminar body having; a flow-passage unit in which are formed ink passages that include pressure chambers; and an actuator for giving pressure to ink in the pressure chambers. The flow-passage unit and the actuator (both not shown) are bonded to each other so as to provide the laminar body. The bottom surface of each ink-jet head 2 is formed as an ejection surface 2*a* from which the ink is ejected. As shown in FIG. 3, the ejection surface 2*a* has a plurality of ejection holes 2*b*, an ejection area 2*c* within which the ejection holes 2*b* are disposed, and a non-ejection area 2*d* which surrounds the ejection area 2*c*. The ejection area 2*c* has a dimension as measured in the main scanning direction that is slightly larger than the dimension of the sheet P as measured in the same direction. Accordingly, it is possible to form an image over an entire surface of the sheet P conveyed by the conveyor mechanism 50, namely, it is possible to conduct marginless printing. In FIG. 3, a maintenance mechanism 30 (which will be explained) is not shown.

As shown in FIG. 2, the sheet supply device 10 includes a sheet cassette 11 in which a stack of sheets P can be accommodated, a sheet supply roller 12 configured to supply an uppermost one of the sheets P from the sheet cassette 11, and a sheet supply motor (not shown) configured to rotate the sheet supply roller 12. The sheet cassette 11 is disposed so as to be attachable to and detachable from the casing 1*a* in a direction perpendicular to the plane of FIG. 2. In a state in which the sheet cassette 11 is installed on the casing 1*a*, the sheet cassette 11 overlaps the conveyor mechanism 50 when viewed from the top of the printer 1. The sheet supply roller 12 is configured to supply the uppermost one of the sheets P from the sheet cassette 11 while being held in rolling contact therewith. The sheet supply motor configured to rotate the sheet supply roller 12 is controlled by the controller 100.

At the left-side portion of the ink-jet printer 1 as seen in FIG. 2, namely, at a portion of a sheet transfer path between the sheet cassette 11 and the conveyor mechanism 50, there are disposed: the sheet guide 17 which extends in a curved form from the sheet cassette 11 toward the conveyor mechanism 50; and two feed rollers 23*a*, 23*b* provided on the downstream side of the sheet guide 17. The sheet guide 17 is constituted by the outer guide surface 17*a* formed on the second door 6 and an inner guide surface 17*b* opposed to the outer guide surface 17*a*. The feed roller 23*b* is rotatably driven by a feed motor (not shown) controlled by the controller 100 while the feed roller 23*a* is a driven roller configured to be rotated as the sheet is transferred.

In the structure described above, the sheet supply roller 12 is rotated clockwise in FIG. 2 by being controlled by the controller 100, whereby the sheet P contacting the sheet supply roller 12 is transferred upward in FIG. 2 through the sheet guide 17. The sheet P is supplied to the conveyor mechanism 50 while being held by the feed rollers 23*a*, 23*b*.

A sensor 73 is disposed at a position which is downstream of the sheet supply roller 12 and is upstream of the sheet guide 17 while a sensor 74 is disposed at a position which is downstream of the sheet guide 17 and is upstream of the feed rollers 23*a*, 23*b*. Each of the sensors 73, 74 is disposed such that its detecting surface is opposed to the sheet P passing through the sheet guide 17. Each sensor 73, 74 is an optical sensor of reflection type configured to detect the sheet P by sensing a light reflected on the surface of the sheet P. The two sensors 73, 74 are disposed at the respective positions at which the two sensors 73, 74 are opposed to the inner central portion of the sheet guide 17 in the main scanning direction. These two sensors 73, 74 are configured to detect the leading end of the sheet P passing through the sheet guide 17. It is noted that each sensor 73, 74 is not limited to the optical sensor of reflection type, but may be an optical sensor of transmission type.

In an instance where the sensor 74 does not detect the leading end of the sheet P even though a prescribed time has been passed after detection of the leading end of the sheet P by the sensor 73, the controller 100 judges that a jam of the sheet P (so-called paper jam) has occurred in the sheet guide 17. In this case, the controller 100 stops rotation of the sheet supply roller 12 and the feed roller 23*b*.

As shown in FIG. 2, the conveyor mechanism 50 includes two belt rollers 51, 52, an endless conveyor belt 53 wound around the two belt rollers 51, 52 so as to be stretched therebetween, a tension roller 55 configured to give tension to the conveyor belt 53, a feed motor (not shown) configured to rotate the belt roller 52, and an adhesion device 60. The two belt rollers 51, 52 are arranged along the sheet conveyance direction indicated "A" in FIG. 2. As shown in FIG. 3, the conveyor belt 53 is opposed to the ejection surfaces 2*a* and has an outer circumferential surface functioning as a conveyor surface 54 on which the sheet P is held.

The belt roller 52 is a drive roller and is configured to be rotated clockwise in FIG. 2 by a feed motor (not shown). The belt roller 51 is a driven roller configured to be rotated clockwise in FIG. 2 by the movement of the conveyor belt 53 in accordance with the rotation of the belt roller 52. As shown in FIG. 2, the tension roller 55 is rotatably supported by the casing 1*a* so as to give tension to the conveyor belt 53 while contacting the inner circumferential surface of the conveyor belt 53 at the lower portion of the loop of the same 53. The tension roller 55 is configured to be rotated clockwise in FIG. 2 by the movement of the conveyor belt 53.

As shown in FIG. 2, the adhesion device 60 is disposed in a region enclosed by the conveyor belt 53 and includes a platen 61 having a generally rectangular parallelepiped shape and a fan 62 disposed below the platen 61. On the upper surface of the platen 61, a plurality of holes (not shown) are formed through the thickness of the platen 61. The plurality of holes are distributed over the entirety of the area of the upper surface of the platen 61, which area is opposed to the conveyor belt 53. The platen 61 has a dimension as measured in the main scanning direction slightly larger than dimensions of the sheet P and the conveyor belt 53 as measured in the same direction.

As shown in FIG. 2, the upper surface of the platen 61 is held in contact with the inner circumferential surface of the conveyor belt 53 at the upper portion of the loop of the belt 53 so as to support the belt 53 from the inside of the loop. According to the arrangement, the conveyor belt 53 at the upper portion of the loop and the ejection surfaces 2*a* of the ink-jet heads 2 are opposed to each other so as to be parallel to each other, and there is formed a slight clearance therebetween. The clearance partially constitutes the sheet transfer path.

The fan 62 has a generally rectangular parallelepiped shape shown in FIG. 2. The fan 62 is configured to suck in the air through suction ports (not shown) formed in its upper surface by rotation of rotary vanes provided in its inside. The fan 62 is controlled by the controller 100.

A pressing roller 48 is located on the upstream side of one of the four ink-jet heads 2 that is disposed on the most upstream side in the sheet conveyance direction A among the four ink-jet heads 2, so as to be opposed to the belt roller 51 with the conveyor belt 53 interposed therebetween. The pressing roller 48 is biased toward the conveyor surface 54 by an elastic member such as a spring (not shown) and is configured to press the sheet P supplied from the sheet supply device 10 onto the conveyor surface 54. The pressing roller 48 is a driven roller configured to be rotated in accordance with the rotary movement of the conveyor belt 53.

In this structure, the conveyor belt 53 rotates by rotation of the belt roller 52 clockwise in FIG. 2 under the control of the controller 100. In this instance, the belt roller 51, the tension roller 55, and the pressing roller 48 are also rotated by the rotary movement of the conveyor belt 53. Further, the fan 62 is driven under the control of the controller 100, so that the air is drawn into the suction ports formed in the fan 62 through all of the plurality of holes formed in the platen 61. According to the arrangement, the sheet P supplied from the sheet supply device 10 is conveyed in the sheet conveyance direction A while adhering to the conveyor surface 54. In the structure, when the sheet P conveyed by and held on the conveyor surface 54 of the conveyor belt 53 passes right below the four ink-jet heads 2, the ink-jet heads 2 controlled by the controller 100 eject the respective inks toward the sheet P, so that an intended color image is formed on the sheet P.

The conveyor mechanism 50 is configured to be moved upward and downward relative to the ink-jet heads 2 by an up/down moving mechanism 80 (FIG. 4) as a relative movement mechanism between a recording position at which an image is recorded or printed on the sheet P with the inks ejected from the ink-jet heads 2 and a sheet removal position (as a medium removal position) at which a distance by which the ejection surfaces 2*a* and the conveyor mechanism 50 are spaced apart from each other is larger than that when the ink-jet heads 2 and the conveyor mechanism 50 are located at the recording position and at which a user is allowed to remove the sheet P when the sheet P is jammed between the ejection surfaces 2*a* and the conveyor mechanism 50. Each of the recording position and the sheet removal position corresponds to relative positions of the ink-jet heads 2 and the conveyor mechanism 50. In other words, the conveyor mechanism 50 is moved upward and downward between the recording position shown in FIG. 2 at which the conveyor mechanism 50 is located close to the ink-jet heads 2 and the sheet removal position at which the conveyor mechanism 50 is located at a height level lower than the recording position.

Figure 4:
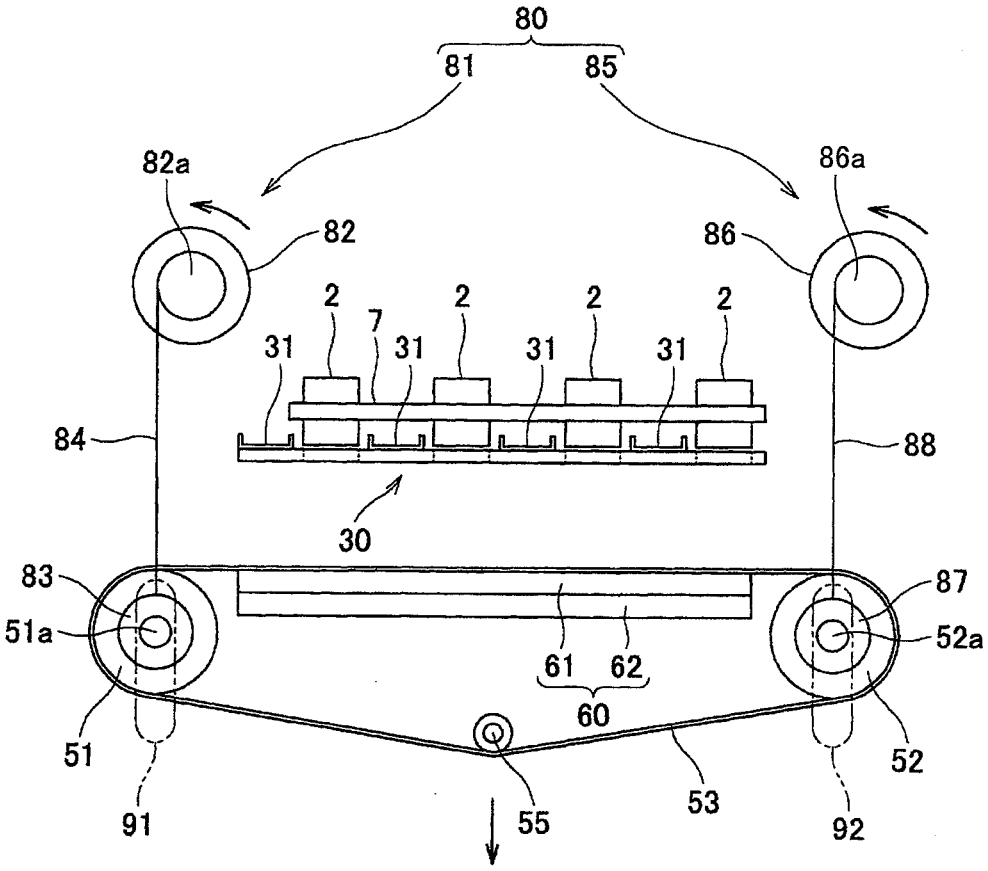
FIG. 4 is a schematic side view showing an up/down moving mechanism.

As shown in FIG. 4, the up/down moving mechanism 80 includes an up/down moving portion 81 configured to move the belt roller 51 upward and downward and an up/down moving portion 85 configured to move the belt roller 52 upward and downward. The up/down moving portion 81 has an up/down motor 82, two rings 83, and wires 84 each as a connecting member. The rings 83 are disposed near respective opposite axial ends of a roller shaft 51*a* of the belt roller 51 and rotatably support the roller shaft 51*a*. Each wire 84 is fixed at one end thereof to the upper end of the corresponding ring 83 and is fixed to and wound around a motor shaft 82*a* of the up/down motor 82 at the other end thereof. At respective positions of the casing 1*a* facing the opposite axial ends of the roller shaft 51*a* of the belt roller 51, guides 91 are formed for guiding the opposite axial ends of the roller shaft 51*a* of the belt roller 51 when the belt roller 51 is moved upward and downward. Each guide 91 is formed such that its upper end coincides with the position of the roller shaft 51*a* at a time when the conveyor mechanism 50 is located at the recording position. The guide 91 extends downward from its upper end.

Similarly, the up/down moving portion 85 has an up/down motor 86, two rings 87, and wires 88. The rings 87 are disposed near respective opposite axial ends of a roller shaft 52*a* of the belt roller 52 and rotatably support the roller shaft 52*a*. Each wire 88 is fixed at one end thereof to the upper end of the corresponding ring 87 and is fixed to and wound around a motor shaft 86*a* of the up/down motor 86 at the other end thereof. At respective positions of the casing 1*a* facing the opposite axial ends of the roller shaft 52*a* of the belt roller 52, guides 92 are formed for guiding the opposite axial ends of the roller shaft 52*a* of the belt roller 52 when the belt roller 52 is moved upward and downward. Each guide 92 is formed such that its upper end coincides with the position of the roller shaft 52*a* at a time when the conveyor mechanism 50 is located at the recording position. The guide 92 extends downward from its upper end.

In the structure, when the two up/down motors 82, 86 are simultaneously driven under the control of the controller 100 and the motor shafts 82*a*, 86*a* are rotated counterclockwise in FIG. 4, the wires 84, 88 are unwound from the respective motor shafts 82*a*, 86*a*, whereby the conveyor mechanism 50 moves downward along the guides 91, 92. That is, the conveyor mechanism 50 is moved from the recording position to the sheet removal position. On the other hand, when the motor shafts 82*a*, 86*a* are rotated clockwise in FIG. 4 under the control of the controller 100, the wires 84, 88 are wound around the respective motor shafts 82*a*, 86*a*, whereby the conveyor mechanism 50 moves upward along the guides 91, 92. That is, the conveyor mechanism 50 is moved from the sheet removal position to the recording position.

The movement of the conveyor mechanism 50 from the recording position to the sheet removal position is conducted in an instance where a jam of the sheet P occurs at the conveyor mechanism 50 in a printing or recording operation in which an image is printed or recorded on the sheet P with the conveyor mechanism 50 located at the recording position. When the conveyor mechanism 50 is located at the sheet removal position, the distance between the ejection surfaces 2*a* and the conveyor mechanism 50 is large, thereby allowing the user easy access to the conveyor mechanism 50 by opening the first door 4, so that the jammed sheet P can be easily removed. Subsequently when the user conducts a prescribed operation such as closing of the first door 4, the controller 100 outputs a jam-clearing completion signal indicative of completion of a jam-clearing processing for clearing the jam of the sheet P, and the conveyor mechanism 50 located at the sheet removal position returns to the recording position.

While the conveyor mechanism 50 is configured to be moved relative to the ink-jet heads 2 by the up/down moving mechanism 80 in the present embodiment, the ink-jet heads 2 may be configured to be moved upward and downward relative to the conveyor mechanism 50 by the up/down moving mechanism 80. Further, both of the ink-jet heads 2 and the conveyor mechanism 50 may be configured to be moved upward and downward such that the conveyor mechanism 50 and the ink-jet heads 2 approach each other or separate away from each other.

As shown in FIG. 2, a separation plate 9 is disposed on the immediately downstream side of the conveyor mechanism 50 in the sheet conveyance direction A. The separation plate 9 is configured to separate the sheet P from the conveyor surface 54 such that the edge of the separation plate 9 is inserted between the sheet P and the conveyor belt 53.

At a portion of the sheet transfer path between the conveyor mechanism 50 and the discharged-sheet receiving portion 15, there are disposed: four feed rollers 21*a*, 21*b*, 22*a*, 22*b*; and the sheet guide 18 located between the feed rollers 21*a*, 21*b* and the feed rollers 22*a*, 22*b*. The feed rollers 21*b*, 22*b* are rotatably driven by a feed motor (not shown) controlled by the controller 100. The feed rollers 21*a*, 22*a* are driven rollers configured to be rotated as the sheet is transferred. The sheet guide 18 is constituted by the outer guide surface 18*a* formed on the third door 5 and an inner guide surface 18 *b* opposed to the outer guide surface 18*a*.

In the arrangement described above, the feed motor is driven under the control of the controller 100 so as to rotate the feed rollers 21*b*, 22*b*, whereby the sheet P conveyed by the conveyor mechanism 50 is transferred upward in FIG. 2 through the sheet guide 18 while being held by the feed rollers 21*a*, 21*b*. Subsequently, the sheet P is discharged to the discharged-sheet receiving portion 15 while being held by the feed rollers 22*a*, 22*b*.

A sensor 75 is disposed at a position which is downstream of the separation plate 9 and is upstream of the feed rollers 21*a*, 21*b* while a sensor 76 is disposed at a position which is downstream of the sheet guide 18 and is upstream of the feed rollers 22*a*, 22*b*. Each of the sensors 75, 76 is disposed such that its detecting surface is opposed to the sheet P passing through the sheet guide 18. Each sensor 75, 76 is an optical sensor of reflection type configured to detect the sheet P by sensing a light reflected on the surface of the sheet P. The two sensors 75, 76 are disposed at respective positions at which the two sensors 75, 76 are opposed to the inner central portion of the sheet guide 18 in the main scanning direction. These two sensors 75, 76 are configured to detect the leading end of the sheet P passing through the sheet guide 18. It is noted that each sensor 75, 76 is not limited to the optical sensor of reflection type, but may be an optical sensor of transmission type.

In an instance where the sensor 76 does not detect the leading end of the sheet P even though a prescribed time has been passed after detection of the leading end of the sheet P by the sensor 75, the controller 100 judges that a jam of the sheet P (so-called paper jam) has occurred in the sheet guide 18. In this case, the controller 100 stops rotation of the feed rollers 21*b*, 22*b*.

As shown in FIG. 2, the maintenance mechanism 30 (as an intervening-member moving mechanism) is disposed between the four ink-jet heads 2 and the conveyor mechanism 50. The maintenance mechanism 30 has four caps 31 each as an intervening member configured to cover the ejection surfaces 2*a* of the respective ink-jet heads 2. Each of the caps 31 is formed of an elastic material such as rubber and having a rectangular shape in plan view whose longitudinal direction is parallel to the longitudinal direction of each ink-jet head 2. Each cap 31 is located, in its initial state, on the immediately upstream side of the corresponding ink-jet head 2, and is moved, in accordance with the movement of the maintenance mechanism 30, in the leftward and rightward direction and in the upward and downward direction as seen in FIG. 2, relative to the corresponding ink-jet head 2.

Figure 5A:
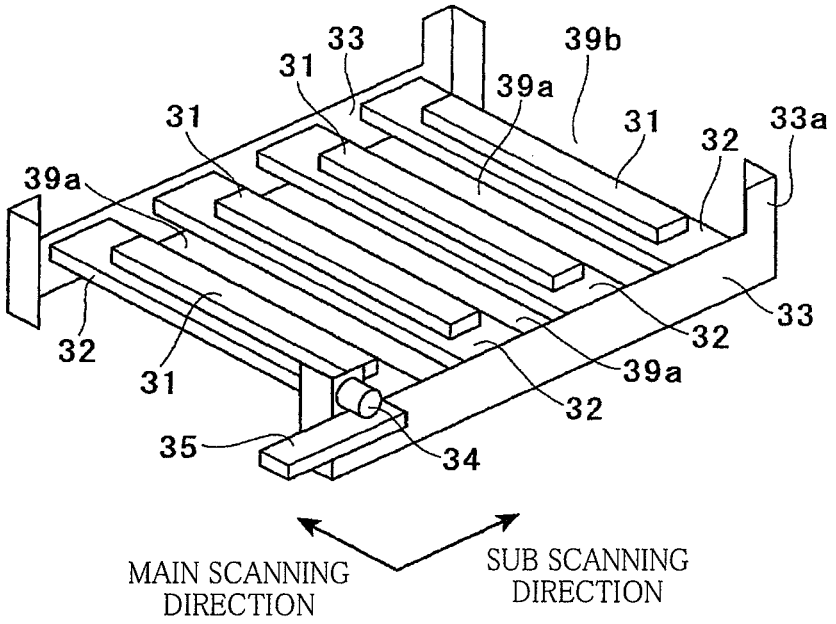
FIGS. 5A and 5B are perspective views showing a maintenance mechanism.

As shown in FIG. 5A, the maintenance mechanism 30 includes: four plate members 32 which are equally spaced apart from each other in the sub scanning direction and each of which has the cap 31 disposed on its upper surface; and a pair of inner frames 33 between which the plate members 32 are held. Each inner frame 33 has protruding corner portions 33*a* that extend upward at respective opposite ends thereof. On one corner portion 33*a* of each inner frame 33, a pinion gear 34 that is fixed to a shaft of a drive motor (not shown) is disposed so as to mesh with a rack gear 35 disposed horizontally. In FIG. 5A, the pinion gear 34 of only one of the inner frames 33 (that is located on the front side as seen in FIG. 2) is shown.

Figure 5B:
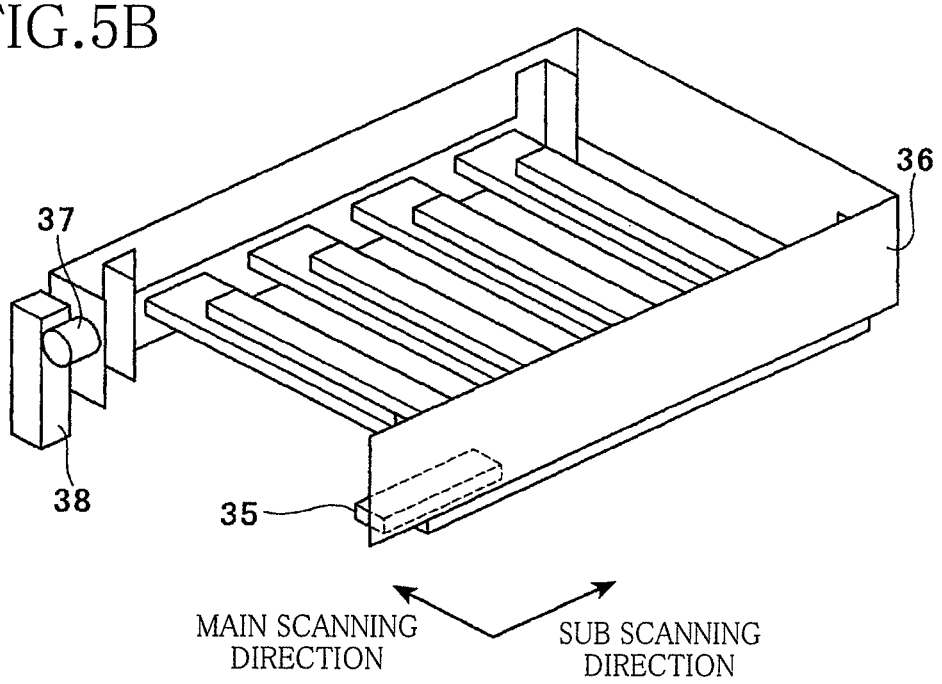

As shown in FIG. 5B, the maintenance mechanism 30 further includes an outer frame 36 disposed so as to enclose the pair of inner frames 33. Inside the outer frame 36, the rack gear 35 shown in FIG. 5A is fixed. A pinion gear 37 that is fixed to a shaft of a drive motor (not shown) is disposed so as to mesh with a rack gear 38 disposed vertically. The rack gear 38 is disposed so as to extend upright in the casing 1*a*.

In the arrangement described above, when the two pinion gears 34 are synchronously rotated, the inner frames 33 are moved in the sub scanning direction. Further, when the pinion gear 37 is rotated, the outer frame 36 is moved in the vertical direction.

Figure 6A:
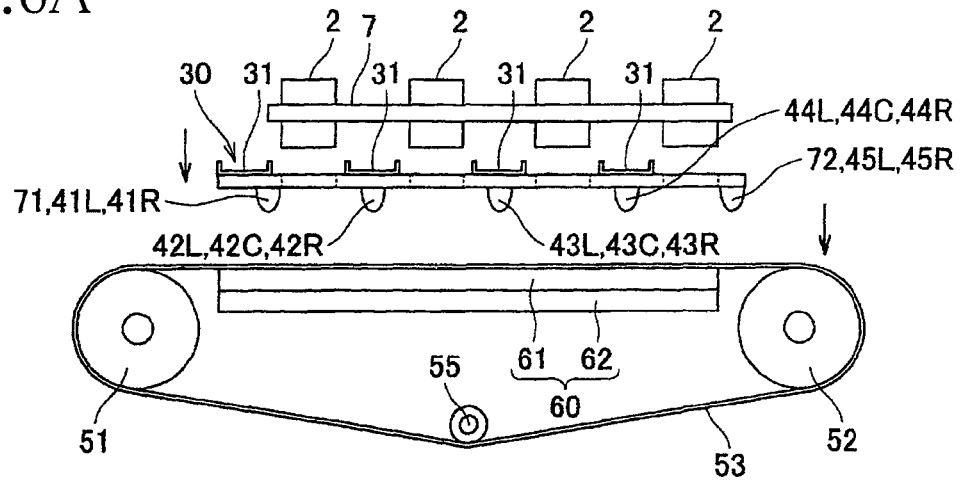
FIGS. 6A-6C are side views showing a capping operation.

More specifically, when the maintenance mechanism 30 is located at an initial position shown in FIG. 2, each plate member 32 is located on the immediately upstream side of the corresponding ink-jet head 2, and three openings 39*a* between any adjacent two plate members 32 and one opening 39*b* between the plate member 32 located on the most downstream side and the corner portions 33*a* of the inner frame 33 are opposed to the respective ejection surfaces 2*a*. When a capping operation for covering the ejection surfaces 2*a* with the corresponding caps 31 is conducted, the outer frame 36 is moved downward in the vertical direction, so that the maintenance mechanism 30 is moved to an intervening position at which the maintenance mechanism 30 is located between the ink-jet heads 2 and the conveyor mechanism 50, as shown in FIG. 6A. On this occasion, the caps 31 are located at a retracted position at which the caps 31 are disposed between the corresponding ink-jet heads 2 and the conveyor mechanism 50 but are not opposed to the ejection surfaces 2*a*.

Figure 6B:
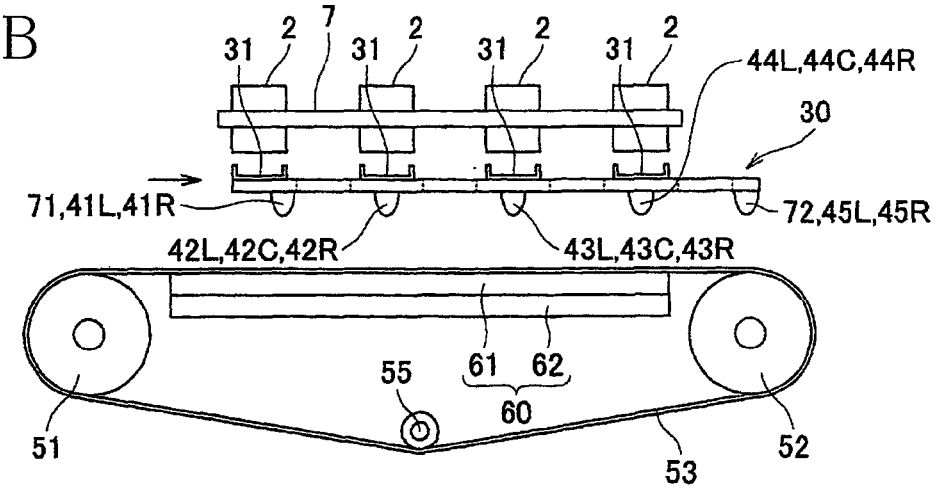
Figure 6C:
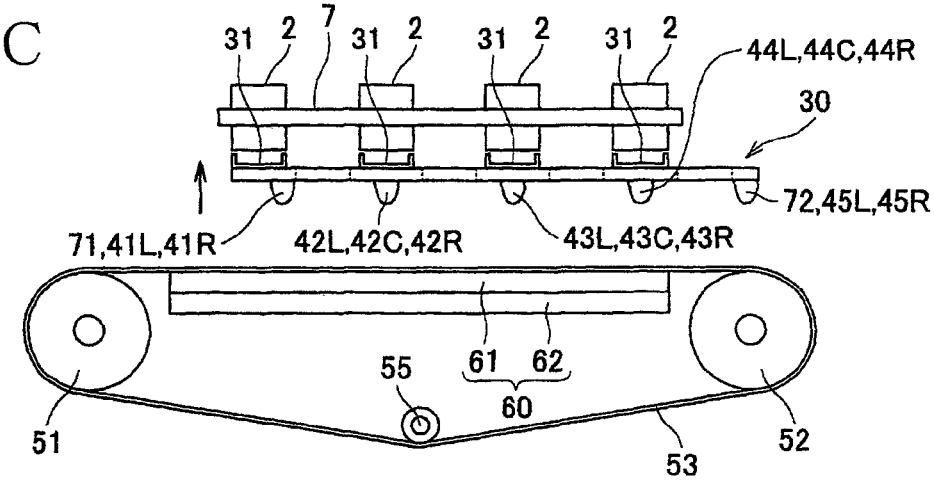

Thereafter, the pair of inner frames 33 are moved downstream in the sub scanning direction. On this occasion, the caps 31 are located at a facing position at which the caps 31 face the corresponding ejection surfaces 2*a*, as shown in FIG. 6B. Then the outer frame 36 is moved upward in the vertical direction, whereby the caps 31 are located at a capping position at which the caps 31 contact the corresponding ejection surfaces 2*a* so as to cover the same 2*a*, as shown in FIG. 6C. According to this procedure, the ejection surfaces 2*a* are covered with the respective caps 31. The caps 31 return back to the initial position by conducting the procedure in a reverse order.

The capping operation described above is conducted with the conveyor mechanism 50 located at the sheet removal position after having been moved downward from the recording position or with the conveyor mechanism 50 located at the recording position. Further, the capping operation is conducted in an instance where a jam of the sheet P occurs at any of the sheet guide 17, the sheet guide 18, and the conveyor mechanism 50. FIGS. 6A-6C show a state in which the conveyor mechanism 50 has been moved by the up/down moving mechanism 80 from the recording position to the sheet removal position after occurrence of a jam of the sheet P at the conveyor mechanism 50.

The maintenance mechanism 30 is provided with two sensors 71, 72, as shown in FIG. 2. More specifically, the sensor 71 is disposed at a location that is upstream of the most upstream inkjet head 2 in the sheet conveyance direction A while the sensor 72 is disposed at a location that is downstream of the most downstream ink-jet head 2 in the sheet conveyance direction A, such that the detecting surface of each of the sensors 71, 72 faces the conveyor surface 54. That is, the sensors 71, 72 are disposed integrally with the caps 31, namely, provided so as to be immovable relative to the caps 31. Each sensor 71, 72 is an optical sensor of reflection type configured to detect the sheet P by sensing a light reflected on the surface of the sheet P. The two sensors 71, 72 are disposed at respective locations at which the two sensors 71, 72 are opposed to the middle portion of the conveyor surface 54 in the main scanning direction. These two sensors 71, 72 are configured to detect the leading end of the sheet P conveyed by the conveyor belt 53. It is noted that each sensor 71, 72 is not limited to the optical sensor of reflection type, but may be an optical sensor of transmission type.

In an instance where the sensor 72 does not detect the leading end of the sheet P even though a prescribed time has been passed after detection of the leading end of the sheet P by the sensor 71, the controller 100 judges that a jam of the sheet P (so-called paper jam) has occurred at the conveyor mechanism 50. In this case, the controller 100 stops ejection of the inks from the respective ink jet heads 2. 22*b*.

In addition to the sensors 71, 72, the maintenance mechanism 30 includes sensors 41R, 41L, sensors 42R, 42C, 42L, sensors 43R, 43C, 43L, sensors 44R, 44C, 44L, and sensors 45R, 45L, which are disposed integrally with the caps 31, namely, provided so as to be immovable relative to the caps 31. Hereinafter, the sensors 71, 72, 41-45 are collectively referred to as a sensor group where appropriate. Here, one of opposite sides of the conveyor surface 54 which extends along the sub scanning direction and which is located on the right-hand side when viewed from the upstream side toward the downstream side of the sheet conveyance direction A is referred to as a right side. The other of the opposite sides of the conveyor surface 54 which extends along the sub scanning direction and which is located on the left-hand side when viewed from the upstream of the sheet conveyance direction is referred to as a left side. The sensor 41R is disposed on the right side of the sensor 71 in the main scanning direction so as to be opposed to the right-side region of the conveyor surface 54. The sensor 41L is disposed on the left side of the sensor 71 in the main scanning direction so as to be opposed to the left-side region of the conveyor surface 54. The sensors 42R, 42C, 42L are disposed between the most upstream ink-jet head 2 and its neighboring ink-jet head 2 located downstream of the most upstream ink-jet head 2, in the sheet conveyance direction A. The sensors 42R, 42C, 42L are located so as to be opposed respectively to the right-side region, the middle region interposed between the right-side region and the left-side region, and the left-side region, of the conveyor surface 54. The sensors 43R, 43C, 43L are disposed between the second ink-jet head 2 from the upstream side and its neighboring ink-jet head 2 located downstream of the second ink-jet head 2, in the sheet conveyance direction A. The sensors 43R, 43C, 43L are located so as to be opposed respectively to the right-side region, the middle region, and the left-side region, of the conveyor surface 54. The sensors 44R, 44C, 44L are disposed between the second ink-jet head 2 from the downstream side and its neighboring ink-jet head 2 located most downstream, in the sheet conveyance direction A. The sensors 44R, 44C, 44L are located so as to be opposed respectively to the right-side region, the middle region, and the left-side region, of the conveyor surface 54. The sensor 45R is disposed on the right side of the sensor 72 in the main scanning direction so as to be opposed to the right-side region of the conveyor surface 54. The sensor 45L is disposed on the left side of the sensor 72 in the main scanning direction so as to be opposed to the left-side region of the conveyor surface 54. In other words, the sensors are arranged in a plurality of rows each of which extends in a direction perpendicular to the sheet conveyance direction and parallel to the ejections surfaces 2*a* and each of which includes three sensors.

The sensors of the sensor group are configured to detect the sheet P existing between the ink-jet heads 2 and the conveyor mechanism 50.

Figure 7A:
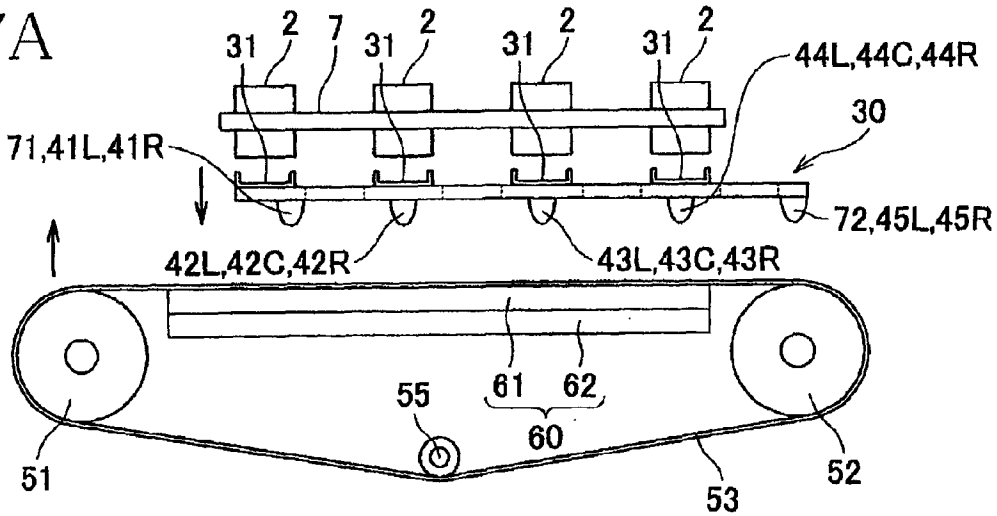
FIGS. 7A and 7B are views showing a part of a return operation after the capping operation.

When the user conducts the prescribed operation such as closing of the first door 4 in a state in which the conveyor mechanism 50 is located at the sheet removal position and in which the capping operation has been conducted, there are conducted a return operation in which the maintenance mechanism 30 returns back to the initial position after the capping operation and a return operation in which the conveyor mechanism 50 located at the sheet removal position returns back to the recording position, as described below. Initially, as shown in FIG. 7A, the outer frame 36 is moved downward in the vertical direction, so that the maintenance mechanism 30 is moved to the intervening position at which the maintenance mechanism 30 is located between the ink-jet heads 2 and the conveyor mechanism 50. On this occasion, the sensors of the sensor group start a detecting or sensing operation for detecting or sensing the sheet P existing between the ink-jet heads 2 and the conveyor mechanism 50. At the same time, the conveyor mechanism 50 located at the sheet removal position starts to move upward to the recording position by the up/down moving mechanism 80. The speed at which the conveyor mechanism 50 is moved upward is lower than the speed at which the conveyor mechanism 50 is moved downward. Further, during the upward movement of the conveyor mechanism 50, the adhesion device 60 is placed, under the control of the controller 100, at its operating state for enabling the sheet P to adhere to the conveyor surface 54 if the sheet P exists on the conveyor surface 54.

Figure 7B:
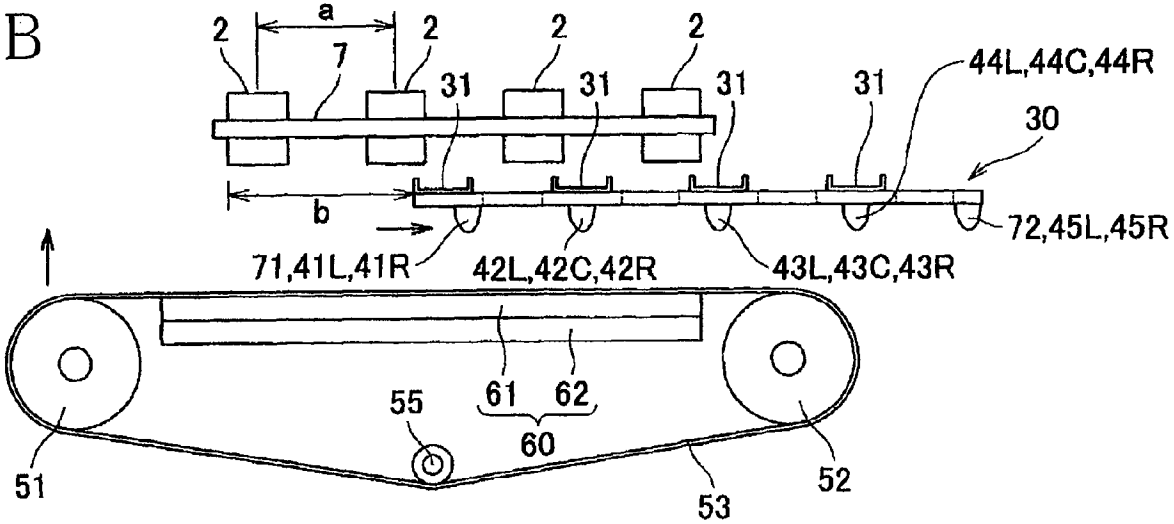

Subsequently, the inner frames 33 are moved toward the downstream side in the sub scanning direction, so that the caps 31 are moved toward the downstream side in a direction parallel to the sheet conveyance direction, by a distance "b" that is larger than a pitch "a" at which the four ink-jet heads 2 are arranged in the sheet conveyance direction A, as indicated in FIG. 7B. On this occasion, the detecting operation by the sensors of the sensor group for detecting the sheet P existing between the ink-jet heads 2 and the conveyor mechanism 50 is being continued, and the upward movement of the conveyor mechanism 50 toward the recording position by the up/down moving mechanism 80 is being continued. Further, on this occasion, the adhesion device 60 is kept in the operating state.

Figure 8A:
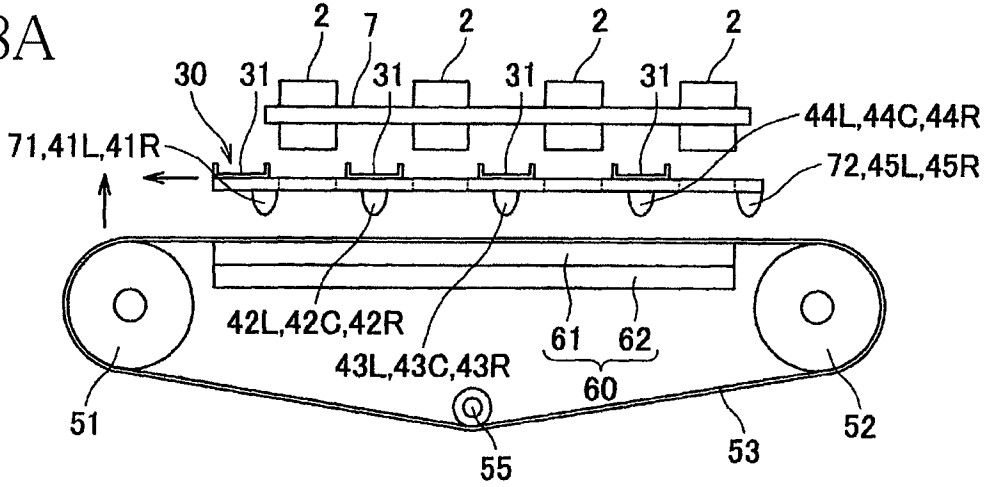
FIGS. 8A and 8B are views showing a part of the return operation after the capping operation.

Thereafter, the inner frames 33 are moved toward the upstream side in the sub scanning direction, so that the caps 31 are moved toward the upstream side in the direction parallel to the sheet conveyance direction, as indicated in FIG. 8A. Accordingly, the caps 31 are placed at the retracted position at which the caps 31 are not opposed to the corresponding ejection surfaces 2*a*. On this occasion, the detecting operation by the sensors of the sensor group for detecting the sheet P existing between the ink-jet heads 2 and the conveyor mechanism 50 is being continued, and the upward movement of the conveyor mechanism 50 toward the recording position by the up/down moving mechanism 80 is being continued. Further, on this occasion, the adhesion device 60 is kept in the operating state.

Figure 8B:
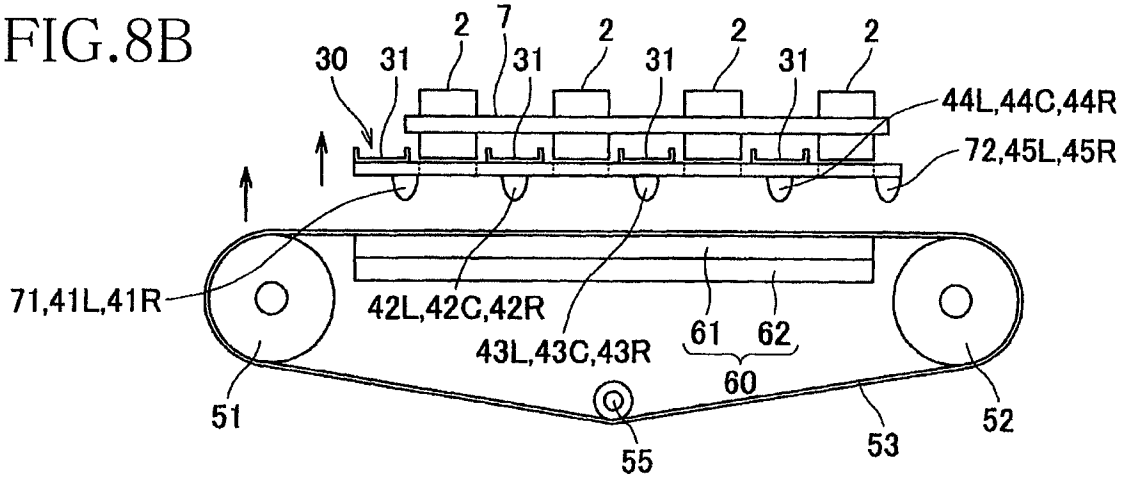

Subsequently, the outer frame 36 is moved upward in the vertical direction, so that the caps 31 return back to the initial position, as shown in FIG. 8B. Further, the conveyor mechanism 50 is placed at the recording position by the up/down moving mechanism 80. Then the detection of the sheet P by the sensors of the sensor group is stopped, and the adhesion device 60 stops operating. According to the procedure described above, the caps 31 return back to the initial position and the conveyor mechanism returns back to the recording position.

Here, when at least one of the sensors of the sensor group detects, in the upward movement of the conveyor mechanism 50 from the sheet removal position to the recording position, the sheet P existing between the ink-jet heads 2 and the conveyor mechanism 50, the up/down moving mechanism 80 stops the upward movement of the conveyor mechanism 50 so as to prevent the conveyor mechanism 50 and the ink-jet heads 2 from approaching relative to each other.

In the arrangement described above, in an instance where a jam of the sheet P (paper jam) occurs between the ink-jet heads 2 and the conveyor mechanism 50, the conveyor mechanism 50 and the ink-jet heads 2 are moved relative to each other so as to be placed at the sheet removal position from the recording position for allowing the user to clear the jam. Specifically, in the present embodiment, the conveyor mechanism 50 is moved relative to the ink-jet heads 2. After completion of the jam-clearing processing, the conveyor mechanism 50 and the ink-jet heads 2 are moved relative to each other from the sheet removal position back to the recording position. In this instance, where any of the sensors detects the sheet P jammed between the conveyor mechanism 50 and the ink-jet heads 2 in the relative movement of the conveyor mechanism 50 and the ink-jet heads 2 from the sheet removal position to the recording position, the conveyor mechanism 50 and the ink-jet heads 2 are stopped from approaching relative to each other. Thus, where the jammed sheet P exists between the ink-jet heads 2 and the conveyor mechanism 50, the conveyor mechanism 50 is inhibited from approaching the ink-jet heads 2 any more, so that the jammed sheet P is prevented from contacting the ink-jet heads 2. Accordingly, it is possible to protect the ink-jet heads 2 from being damaged by the jammed sheet P.

In the present embodiment, the conveyor mechanism 50 is moved upward from the sheet removal position back to the recording position at a speed lower than a speed at which the conveyor mechanism 50 is moved downward from the recording position to the sheet removal position. The arrangement increases a time period during which the sensors can detect the jammed sheet P, resulting in an enhanced accuracy of detecting the jammed sheet P by the sensors of the sensor group.

The sensors of the sensor group are provided integrally with the caps 31 located between the ink-jet heads 2 and the conveyor mechanism 50. Accordingly, the jammed sheet P can be detected well before the jammed sheet P contacts the ink-jet heads 2.

In the upward movement of the conveyor mechanism 50 from the sheet removal position to the recording position, the caps 31 on which the sensors of the sensor group are integrally provided are moved toward the downstream side in the direction parallel to the sheet conveyance direction, whereby the jammed sheet P can be detected over a wide range in the direction parallel to the sheet conveyance direction.

The caps 31 on which the sensors of the sensor group are integrally provided are moved by the distance "b" larger than the pitch "a" at which the ink-jet heads 2 are arranged in the sheet conveyance direction A. Accordingly, even if the jammed sheet P exists between any adjacent two heads 2, the jammed sheet P can be detected.

The adhesion device 60 is kept in its operating state for permitting the jammed sheet P to adhere to the conveyor surface 54, in the upward movement of the conveyor mechanism 50 from the sheet removal position to the recording position, whereby the jammed sheet P can be prevented from contacting the ink-jet heads 2.

The sensors of the sensor group are arranged in a plurality of rows each including three sensors in the present embodiment and each extending in the direction perpendicular to the sheet conveyance direction and parallel to the ejection surfaces 2*a*, namely, in a depth direction of the sheet P. Accordingly, even if the jammed sheet P is not located evenly in the depth direction, the jammed sheet P can be detected.

<Electric Structure of Ink-Jet Printer>

Figure 9:
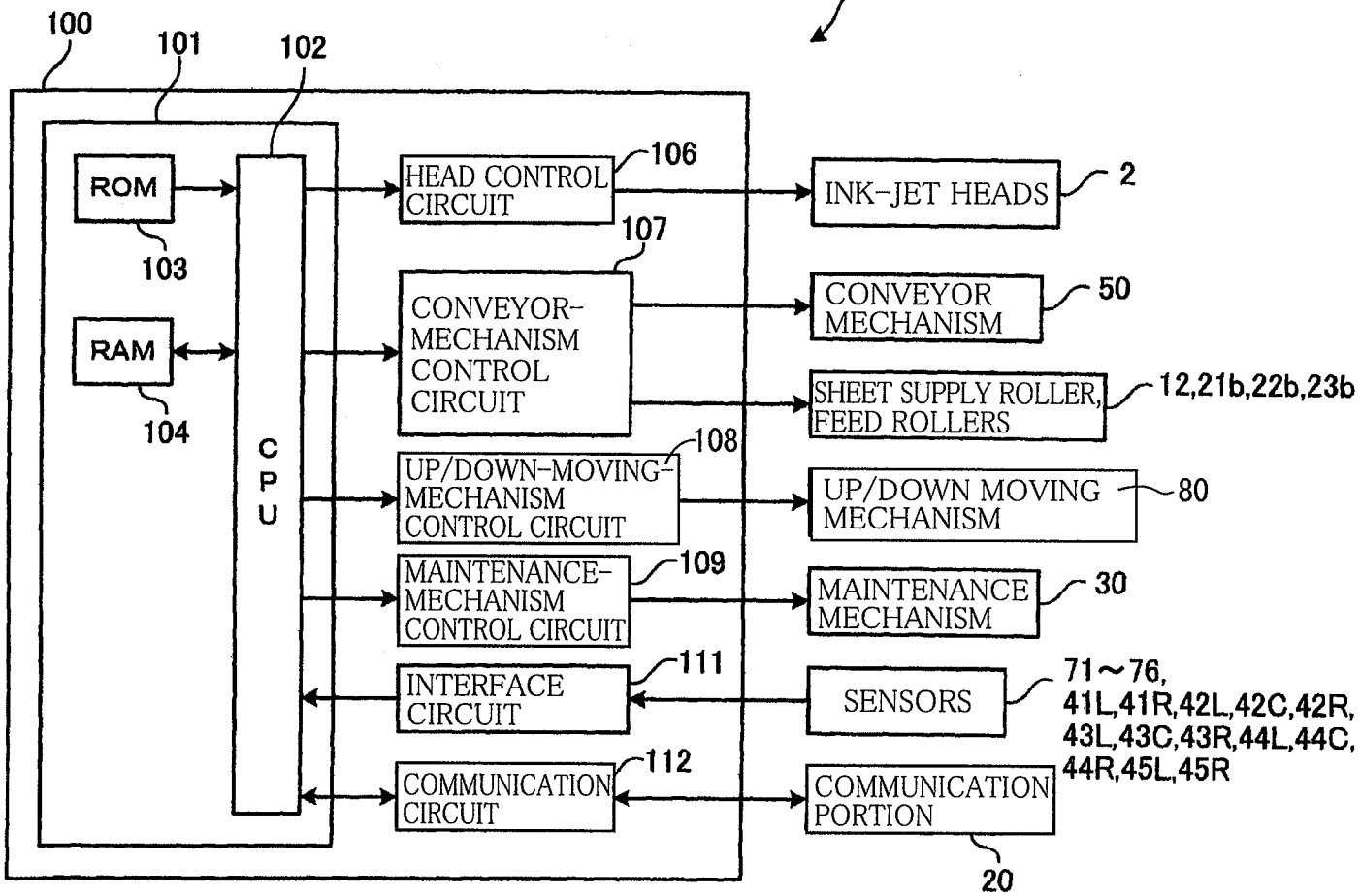
FIG. 9 is a diagram showing an electrical structure of the ink-jet printer.

The operations of the ink-jet printer 1 are controlled by the controller 100, as shown in FIG. 9. The controller 100 is constituted by a microcomputer 101 as its main constituent element disposed on a circuit board, and various circuits. The microcomputer 101 includes a CPU 102 for controlling various operations according to preset programs, a ROM 103 for storing various programs, and a RAM 104 as a temporary memory device.

To the CPU 102, there are connected: a head control circuit 106 for controlling the ink-jet heads 2; a conveyor-mechanism control circuit 107 for controlling the conveyor mechanism 50, the feed rollers 21*b*, 22*b*, 23*b*, and the sheet supply roller 12; an up/down-moving-mechanism control circuit 108 for controlling the up/down moving mechanism 80; a maintenance-mechanism control circuit 109 for controlling the maintenance mechanism 30; an interface circuit 111 to which sheet detection signals from the sensors 71-76 and the sensors 41-45 are inputted; and a communication circuit 112 for performing communication with a general-purpose personal computer (not shown) or the like via a communication portion 20.

The head control circuit 106 controls the ink-jet heads 2 to eject the inks toward the sheet P, on the basis of recording or printing data transmitted from the personal computer or the like via the communication portion 20. In this instance, the head control circuit 106 as a recording control device controls the ink-jet heads 2 to start ejection of the inks toward the sheet P a predetermined time after the sensor 71 has detected the leading end of the sheet P conveyed by the conveyor mechanism 50. The above-indicated predetermined time is equal to a time obtained by dividing a distance, along the sheet transfer path, between the position of the leading end of the sheet P when the sensor 71 detects the leading end and the position of the ejection holes 2*b* which are located most upstream in the most upstream one of the four ink-jet heads 2, by a speed at which the sheet P is transferred.

Thus, the sensor 71 used in detecting the sheet P existing between the ink-jet heads 2 and the conveyor mechanism 50 is also used in detection of the sheet P in the recording operation as described above, resulting in a reduction of the number of required components and the cost of the ink-jet printer 1.

The conveyor-mechanism control circuit 107 is configured to control the conveyor mechanism 50, the feed rollers 21*b*, 22*b*, 23*b*, and the sheet supply roller 12 such that the sheet P is transferred from the sheet supply device 10 to the discharged-sheet receiving portion 15. In particular, the conveyor-mechanism control circuit 107 when functioning as an adhesion control device is configured to control the adhesion device 60 so as to permit the sheet P to adhere to the conveyor surface 54 in a second operation explained below.

The up/down-moving-mechanism control circuit 108 is configured to control the up/down moving mechanism 80 such that the conveyor mechanism 50 is moved away from the ink-jet heads 2 when a jam of the sheet P that is being conveyed has occurred in the conveyor mechanism 50, for instance. Further, the up/down-moving-mechanism control circuit 108 is configured to control the up/down moving mechanism 80 such that the conveyor mechanism 50 is moved toward the ink-jet heads 2 when the jam-clearing processing by the user has completed, for instance.

The up/down-moving-mechanism control circuit 108 as a relative-movement control device has a first control portion to control the up/down moving mechanism 80 to conduct a first operation in which the conveyor mechanism 50 and the ink-jet heads 2 are moved relative to each other from the recording position to the sheet removal position when a jam of the sheet P occurs between the ink-jet heads 2 and the conveyor mechanism 50. The CPU 102 as an output device is configured to output the jam-clearing signal indicative of completion of the jam-clearing processing for removing the jammed sheet, in response to the prescribed operation by the user. Further, the first control portion is configured to control the up/down moving mechanism 80 to conduct, after the first operation, a second operation in which the conveyor mechanism 50 and the ink-jet heads 2 are moved relative to each other from the sheet removal position back to the recording position when the jam-clearing signal is outputted. In this respect, the first control portion is configured to control the up/down moving mechanism 80 to conduct the second operation at a speed less than a speed at which the first operation is conducted. The up/down-moving-mechanism control circuit 108 as the relative-movement control device further has a second control portion to control the up/down moving mechanism 80 to prevent the relative movement of the conveyor mechanism 50 and the ink-jet heads 2 toward each other where the sensors of the sensor group detect the sheet P in the second operation.

The maintenance-mechanism control circuit 109 is configured to control the maintenance mechanism 30 to conduct the capping operation when a jam of the sheet P that is being conveyed or transferred occurs. In particular, the maintenance-mechanism control circuit 109 as an intervening-member-movement control device is configured to control the maintenance mechanism 30 such that the caps 31 move, in the second operation, in the direction parallel to the sheet conveyance direction. Further, the maintenance-mechanism control circuit 109 is configured to control the maintenance mechanism 30 such that the caps 31 are moved by the distance "b" larger than the pitch "a" at which the four ink-jet heads 2 are arranged in the sheet conveyance direction A.

The CPU 102 judges that a jam of the sheet P has occurred only when a time interval of detection of the sheet P by the two sensors in each of the three sets of sensors, i.e., the sensors 71 and 72, the sensors, 73 and 74, and the sensors 75 and 76, exceeds respective preset values. In other words, the CPU 102 judges that a jam of the sheet P has occurred in an instance where the downstream-side sensor of each set does not detect the leading end of the sheet P before a prescribed time elapses after detection of the leading end of the sheet P by the upstream-side sensor of the set. The prescribed time is equal to a time obtained by diving the distance between the two sensors in each set along the sheet transfer path, by the sheet transfer speed.

More specifically, the CPU 102 initially judges that a jam of the sheet P has occurred in the sheet guide 17 in an instance where the sensor 74 does not yet detect the leading end of the sheet P at an expected time point at which the prescribed time has elapsed from the time point of detection of the leading end of the sheet P by the sensor 73, namely, in an instance where the sensor 74 does not detect the leading end of the sheet P before the prescribed time elapses after detection of the leading end of the sheet P by the sensor 73. Here, the prescribed time is equal to a time obtained by dividing the distance between the sensor 73 and the sensor 74, by the sheet transfer speed. That is, the CPU 102 detects an occurrence of the sheet jam in the sheet guide 17. The CPU 102 next judges that a jam of the sheet P has occurred at the conveyor mechanism 50 in an instance where the sensor 72 does not detect the leading end of the sheet P before the prescribed time elapses after detection of the leading end of the sheet P by the sensor 71. Here, the prescribed time is equal to a time obtained by dividing the distance between the sensor 71 and the sensor 72, by the sheet transfer speed. That is, the CPU 102 when functioning as an output device with the sensors 71, 72 judges an occurrence of the sheet jam between the ink-jet heads 2 and the conveyor mechanism 50. The CPU 102 then judges that a jam of the sheet P has occurred in the sheet guide 18 in an instance where the sensor 76 does not detect the leading end of the sheet P before the prescribed time elapses after detection of the leading end of the sheet P by the sensor 75. Here, the prescribed time is equal to a time obtained by dividing the distance between the sensor 75 and the sensor 76, by the sheet transfer speed. That is, the CPU 102 detects an occurrence of the sheet jam in the sheet guide 18.

The head control circuit 106 and the conveyor-mechanism control circuit 107 stop ejection of the ink from each ink-jet head 2 and stop conveyance of the sheet P by the conveyor mechanism 50 where the CPU 102 judges that the sheet jam has occurred. Where the time interval of detection of the sheet P by the two sensors in each of the three sets of sensors is held within the prescribed time and the CPU 102 does not judge the occurrence of the sheet jam, the inks are ejected to the sheet P in a state in which the ink-jet heads 2 are opposed to the sheet P, whereby an image is formed on the sheet P. The image-formed sheet P is discharged onto the discharged-sheet receiving portion 15.

<Operations of the Ink-Jet Printer>

Figure 10:
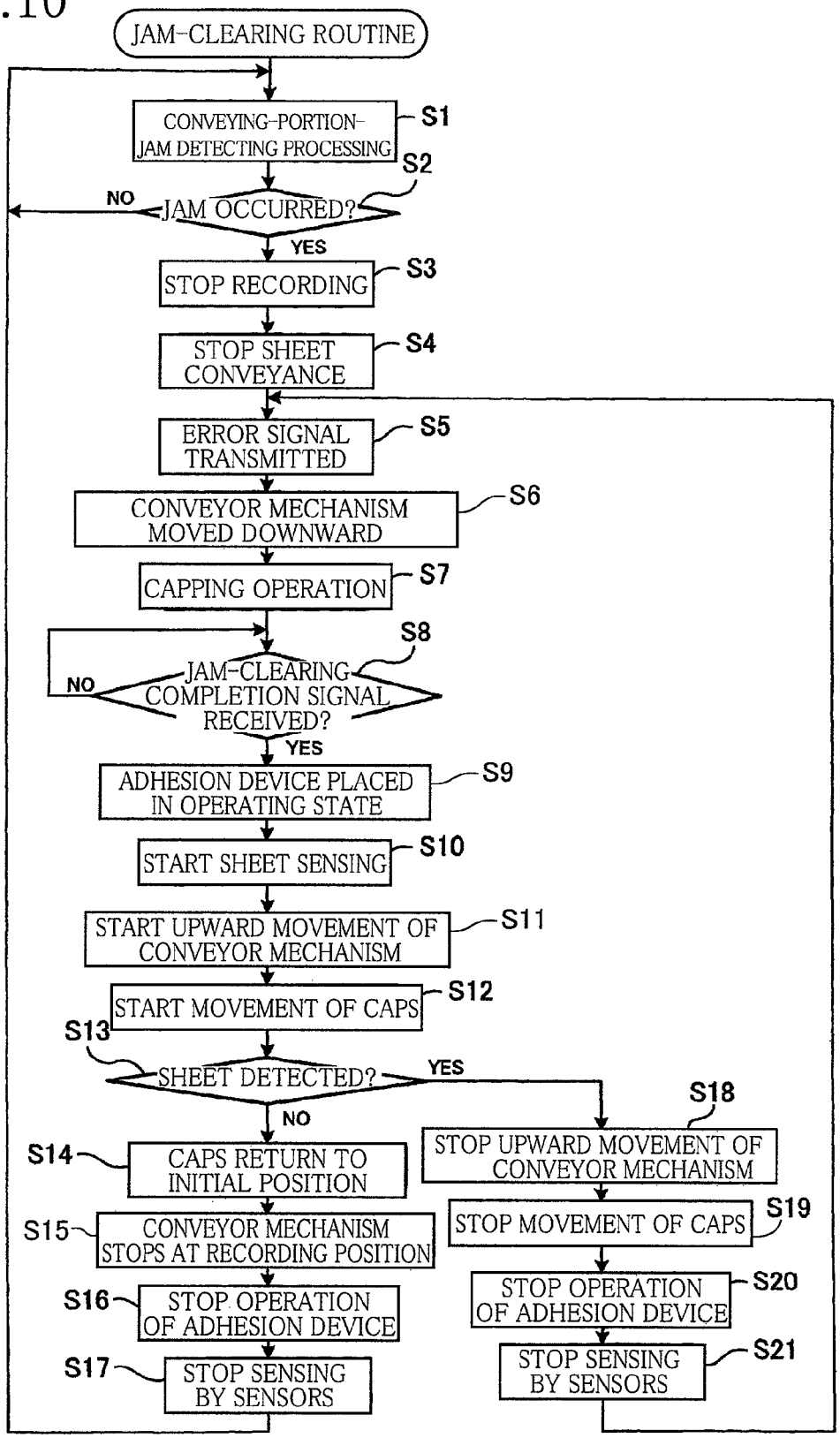
FIG. 10 is a view showing a jam-clearing routine.

There will be next explained operations of the thus constructed ink-jet printer 1 referring to a jam-clearing routine shown in FIG. 10. The jam-clearing routine of FIG. 10 is a routine for dealing with a sheet jam at the conveyor mechanism 50. Sheet jams in the sheet guides 17, 18 are dealt with according to respective routines, which are not explained here.

The jam-clearing routine shown in FIG. 10 starts with step S1 (hereinafter "step" is omitted where appropriate) in which a conveyor-portion-jam detecting processing (that will be explained with reference to the routine of FIG. 11) is conducted. S1 is followed by S2 to judge whether a sheet jam has occurred at the conveyor mechanism 50. Where it is judged that the sheet jam has not occurred, the control flow goes back to S1. On the other hand, where it is judged that the sheet jam has occurred, S3 is implemented in which the head control circuit 106 controls the ink-jet heads 2 so as to stop the recording operation and S4 is implemented in which the conveyor-mechanism control circuit 107 controls the conveyor mechanism 50, the feed rollers 21*b*, 22*b*, 23*b*, and the sheet supply roller 12 so as to stop conveyance or transfer of the sheet P. Then S5 is implemented in which an error signal is transmitted from the communication circuit 112 to the exterior via the communication portion 20.

Subsequently, S6 is implemented in which the up/down-moving-mechanism control circuit 108 controls the up/down moving mechanism 80 to move the conveyor mechanism 50 downward, so that the conveyor mechanism 50 is placed at the sheet removal position distant from the ink-jet heads 2. S6 is followed by S7 in which the maintenance-mechanism control circuit 109 controls the maintenance mechanism 30 to conduct the capping operation in which the ejection surfaces 2*a* are covered with the caps 31. In this state, the user is allowed to conduct the jam-clearing processing to remove the jammed sheet P, by opening the first door 4.

Thereafter, it is judged in S8 whether the jam-clearing completion signal indicative of completion of the jam-clearing processing by the user has been received. Where it is judged that the jam-clearing completion signal is not received yet, S8 is repeatedly implemented until the jam-clearing completion signal is received. On the other hand, where it is judged that the jam-clearing completion signal has been received, S9 is implemented in which the conveyor-mechanism control circuit 107 controls the conveyor mechanism 50 such that the adhesion device 60 is placed in its operating state for permitting the sheet P to adhere to the conveyor surface 54 if the sheet P exists at the conveyor mechanism 50. Subsequently, the sensors of the sensor group start detecting or sensing the sheet P.

Thereafter, S11 is implemented in which the up/down-moving-mechanism control circuit 108 controls the up/down moving mechanism 80 to move the conveyor mechanism 50 upward. It is noted that the speed of the upward movement of the conveyor mechanism 50 is lower than the speed of the downward movement of the same 50. Then S12 is implemented in which the maintenance-mechanism control circuit 109 controls the maintenance mechanism 30 to start a movement of the caps 31 back to the initial position, in which the caps 31 are initially moved to the downstream side in the direction parallel to the sheet conveyance direction by a distance "b" larger than the pitch "a" at which the ink-jet heads 2 are arranged in the sheet conveyance direction A. Then S13 is implemented to judge whether any of the sensors of the sensor group has detected or sensed the sheet P.

Where it is judged in S13 that the sheet P has not been detected, S14 is implemented in which the maintenance-mechanism control circuit 109 controls the maintenance mechanism 30 such that the caps 31 return to the initial position. Then S15 is implemented in which the up/down-moving-mechanism control circuit 108 controls the up/down moving mechanism 80 such that the conveyor mechanism 50 stops at the recording position. Subsequently, S16 is implemented to stop the operation by the adhesion device 60 which permits the sheet P to adhere to the conveyor surface 54, and S17 is implemented to stop the sensors of the sensor group from detecting or sensing the sheet P. Them the control flow goes back to S1.

In an instance where it is judged in S13 that the sheet P has been detected, S18 is implemented in which the up/down-moving-mechanism control circuit 108 controls the up/down moving mechanism 80 to stop the upward movement of the conveyor mechanism 50. Subsequently, S19 is implemented in which the maintenance-mechanism control circuit 109 controls the maintenance mechanism 30 to stop the movement of the caps 31. Thereafter, S20 is implemented to stop the operation by the adhesion device 60 which permits the sheet P to adhere to the conveyor surface 54, and S21 is implemented to stop the sensors of the sensor group from detecting or sensing the sheet P. Then the control flow goes back to S5, and the capping operation is again conducted to cover the ejection surfaces 2*a* with the caps 31. In this state, the user is allowed to again conduct the jam-clearing processing to clear the jam of the sheet P.

Figure 11:
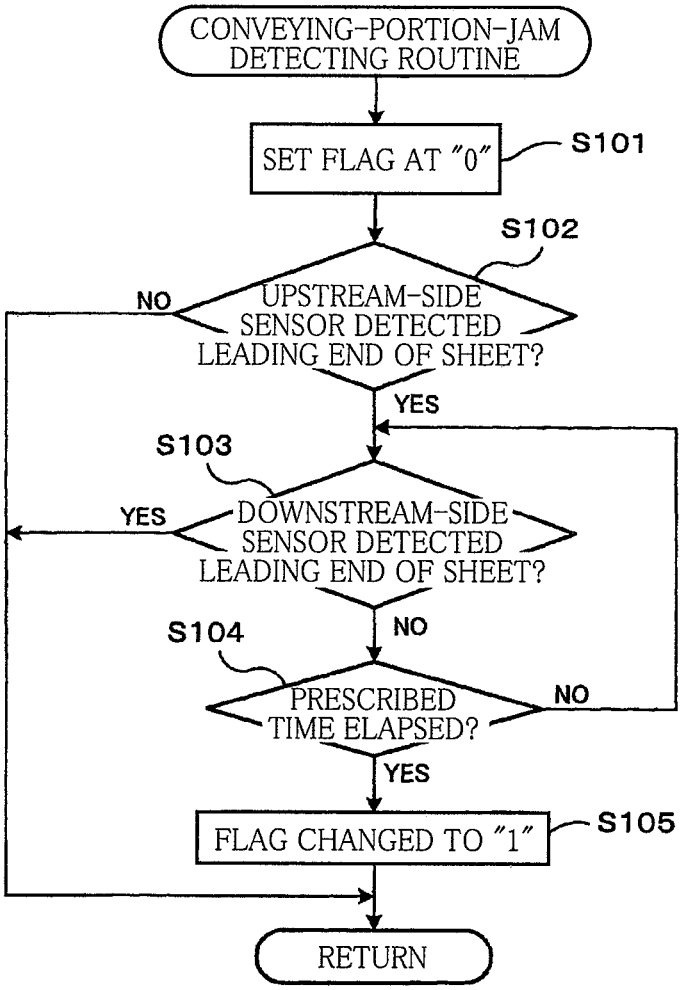
FIG. 11 is a view showing a routine for detecting a jam at a conveyor portion.

There will be next explained a conveyor-portion-jam detecting routine executed in S1 of the routine of FIG. 10, with reference to FIG. 11. As shown in FIG. 11, a flag is set at "0" in S101. The flag is used for judging in S2 of the routine of FIG. 10 whether the sheet jam has occurred or not. In an instance where the sheet jam has occurred, the flag is changed to "1". That is, where the flag is "1", it is judged that the sheet jam has occurred at the conveyor mechanism 50.

Subsequently, it is judged in S102 whether the upstream-side sensor 71 has detected the leading end of the sheet P. Where it is judged in S102 that the upstream-side sensor 71 has not yet detected the leading end of the sheet P, the sub routine is ended and goes back to the jam-clearing routine of FIG. 10.

On the other hand, where it is judged in S102 that the upstream-side sensor 71 has detected the leading end of the sheet P, it is judged in S103 whether the downstream-side sensor 72 has detected the leading end of the sheet P. Where it is judged in S103 that the downstream-side sensor 71 has detected the leading end of the sheet P, the sub routine is ended and goes back to the jam-clearing routine of FIG. 10.

On the other hand, where it is judged in S103 that the downstream-side sensor 72 has not yet detected the leading end of the sheet P, it is judged in S104 that the prescribed time has elapsed. Where it is judged in S104 that the prescribed time has not elapsed, the control flow goes back to S103. On the other hand, where it is judged in S104 that the prescribed time has elapsed, it is judged that the sheet jam has occurred and the flag is changed from "0" to "1" in S105. Thus, the sub routine is ended and the control flow goes back to the jam-clearing routine of FIG. 10.

2. Second Embodiment

<Mechanical Structure of Ink-Jet Printer>

Figure 12:
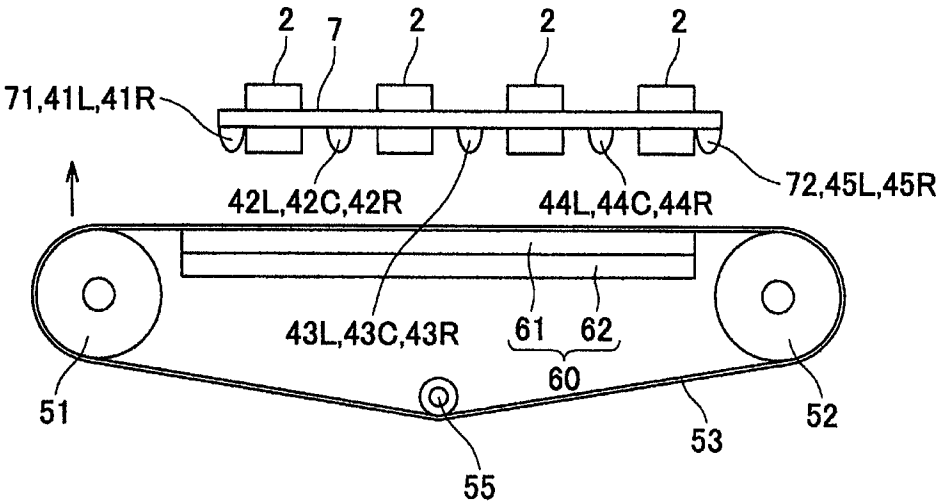
FIG. 12 is a side view showing a part of an internal structure of an ink-jet printer according to a second embodiment of the invention.

Next, there will be explained an ink-jet printer 1 according to a second embodiment with reference to FIG. 12. The ink-jet printer of the second embodiment differs from the ink-jet printer of the first embodiment in that the ink-jet printer of the second embodiment does not have the maintenance mechanism 30 and that the sensors of the sensor group are disposed integrally with the ink-jet heads 2, namely, disposed so as to be immovable relative to the ink-jet heads 2, at the lower surface of the frame 7 to which the ink-jet heads 2 are fixed.

More specifically, the sensors 71, 41L, 41R are disposed upstream of the most upstream ink-jet head 2. The sensors 42L, 42C, 42R are disposed between the most upstream ink-jet head 2 and its neighboring ink-jet head 2 located downstream of the most upstream ink-jet head 2. The sensors 43L, 43C, 43R are disposed between the second ink-jet head 2 from the upstream side and its neighboring ink-jet head 2 located downstream of the second ink-jet head 2. The sensors 44L, 44C, 44R are disposed between the most downstream ink-jet head 2 and its neighboring ink-jet head 2 located upstream of the most downstream ink-jet head 2. The sensors 72, 45L, 45R are disposed downstream of the most downstream ink-jet head 2.

These sensors of the sensor group are configured to detect the jammed sheet existing between the conveyor mechanism 50 and the ink-jet heads 2 which are moved relative to each other from the sheet removal position to the recording position.

As described above, the sensors of the sensor group are disposed integrally with the ink-jet heads 2, namely, disposed so as to be immovable relative to the ink-jet heads 2, whereby it is possible to detect the jammed sheet P before the jammed sheet comes into contact with the ink-jet heads 2. Further, the sensors 42L, 42C, 42R, the sensors 43L, 43C, 43R, and the sensors 44L, 44C, 44R are disposed between corresponding adjacent two ink-jet heads 2, whereby the jammed sheet P can be detected even when the jammed sheet P exists between any adjacent two ink-jet heads 2.

The ink-jet printer of the second embodiment is identical with the ink-jet printer of the first embodiment except for the above structure, and a detailed explanation is dispensed with.

<Modifications>

While the presently preferred embodiments have been described, it is noted that the invention is not limited to the details of the illustrated embodiments, but may be embodied with various changes and modifications, which may occur to those skilled in the art, without departing from the spirit and scope of the invention defined in the attached claims. It is further noted that the effects of the invention described in the illustrated embodiments are preferable ones arising from the invention and that the effects of the invention are not limited to those described in the illustrated embodiments.

In the illustrated embodiments, the upward movement of the conveyor mechanism 50 is stopped where the jammed sheet P is detected in the second operation in which the conveyor mechanism 50 is moved to the recording position. In this instance, the conveyor mechanism 50 may be configured to be moved downward to the sheet removal position.

The second operation in which the conveyor mechanism 50 is moved to the recording position may be conducted at a speed not lower than the speed at which is conducted the first operation in which the conveyor mechanism 50 is moved to the sheet removal position.

In the illustrated embodiments, the sensors 71 72 for detecting the sheet P between the ink-jet heads 2 and the conveyor mechanism 50 are configured to be used for detecting the sheet P in the recording operation of recording an image on the sheet P. Other sensors may be provided to be used for detecting the sheet P in the recording operation.

In the illustrated embodiments, the adhesion device 60 may be configured not to be placed in the operating state in the second operation in which the conveyor mechanism 50 is moved to the recording position.

In the illustrated embodiments, the sensors may not be arranged in a plural number in the direction perpendicular to the sheet conveyance direction and parallel to the ejection surfaces 2*a*.

The ink-jet recording apparatus according to the present invention is not limited to the ink-jet type, but may be applicable to a thermal type. Further, the ink-jet recording apparatus according to the present invention is not limited to the line type, but may be applicable to a serial type in which the heads are reciprocated. The principle of the invention may be applicable to not only the printer, but also a facsimile machine, a copying machine, and the like. While the conveyor mechanism 50 in the illustrated embodiments is configured to convey the sheet P in the horizontal direction, the conveyor mechanism 50 may be configured to convey the sheet P in directions other than the horizontal direction such as a direction inclined with respect to the horizontal direction, the vertical direction, etc., by arranging the conveyor surface 54 such that the conveyor surface 54 that is parallel to the ejection surfaces 2 is inclined or vertical with respect to the horizontal direction.

What is claimed is:

1. An ink jet recording apparatus, comprising:

an inkjet head in which is formed an ejection surface from which ink is ejected;

a conveyor mechanism which has a conveyor surface opposed to the ejection surface and which is configured to convey a recording medium placed on the conveyor surface, in a medium conveyance direction;

a relative movement mechanism configured to move at least one of the conveyor mechanism and the ink-jet head relative to each other such that the conveyor mechanism and the ink jet head are located selectively at one of: a recording position at which an image is recorded on the recording medium with the ink ejected from the ink jet head; and a medium removal position at which a distance between the ejection surface and the conveyor mechanism is larger than that when the conveyor mechanism and the ink jet head are located at the recording position and at which a jammed recording medium jammed between the ejection surface and the conveyor mechanism is allowed to be removed by a user;

a detecting device configured to detect an occurrence of a jam of the recording medium between the ink jet head and the conveyor mechanism;

an output device configured to output a jam-clearing completion signal indicative of completion of a jam-clearing processing for clearing the jam of the recording medium, in response to a prescribed operation by a user;

a sensor for detecting the recording medium existing between the ink jet head and the conveyor mechanism; and a relative-movement control device configured to control the relative movement mechanism and including (a) a first control portion configured to control the relative movement mechanism such that the relative movement mechanism conducts a first operation in which said at least one of the conveyor mechanism and the ink jet head is moved relative to each other such that the conveyor mechanism and the ink jet head are located at the medium removal position from the recording position when the detecting device detects the occurrence of the jam of the recording medium and such that the relative movement mechanism conducts, after the first operation, a second operation in which said at least one of the conveyor mechanism and the ink-jet head is moved relative to each other such that the conveyor mechanism and the ink-jet head are located at the recording position from the medium removal position when the output device outputs the jam-clearing completion signal and (b) a second control portion configured to control the sensor to start detecting the recording medium existing between the ink jet head and the conveyor mechanism after the jam-completion signal has been output and before the second operation is conducted and to control the relative movement mechanism to prevent the conveyor mechanism and the ink-jet head from moving relatively toward each other when the sensor detects the recording medium in the second operation, wherein the ink jet recording apparatus further comprises an intervening member which is located so as to be interposed between the ink jet head and the conveyor mechanism when the first control portion controls the relative movement mechanism to conduct the first operation, and wherein the sensor is disposed integrally with the intervening member.

2. The ink jet recording apparatus according to claim 1, wherein the second control portion is configured to halt the second operation.

3. The ink jet recording apparatus according to claim 1, wherein the first control portion is configured to control the relative movement mechanism to conduct the second operation at a speed less than a speed at which the first operation is conducted.

4. The ink jet recording apparatus according to claim 1, further comprising a recording control device configured to control timing of ejection of the ink from the ink jet head in recording the image on the recording medium, on the basis of timing of detection of a leading end of the recording medium by the sensor.

5. The ink jet recording apparatus according to claim 1, comprising a plurality of inkjet heads each as the inkjet head, wherein the sensor is disposed between any adjacent two of the plurality of ink jet heads.

6. The ink jet recording apparatus according to claim 1, further comprising: an intervening-member moving mechanism configured to move the intervening member in a direction parallel to the medium conveyance direction; and an intervening-member-movement control device configured to control the intervening-member moving mechanism such that the intervening member moves, in the second operation, in the direction parallel to the medium conveyance direction.

7. The ink jet recording apparatus according to claim 6, comprising a plurality of ink-jet heads each as the ink-jet head arranged in the medium conveyance direction, wherein the intervening-member-movement control device is configured to control the intervening-member moving mechanism such that the intervening member is moved by a distance larger than at a pitch at which the plurality of ink jet heads are arranged in the medium conveyance direction.

8. The ink jet recording apparatus according to claim 1, wherein the conveyor mechanism includes a conveyor belt having the conveyor surface.

9. The ink jet recording apparatus according to claim 1, comprising a plurality of sensors each as the sensor disposed along a direction that is perpendicular to the medium conveyance direction and is parallel to the ejection surface.

10. The ink jet recording apparatus according to claim 1, comprising a plurality of ink-jet heads each as the ink-jet head and a plurality of sensors each as the sensor, wherein the plurality of sensors are arranged in a plurality of rows each extending in a direction perpendicular to the medium conveyance direction, and each of the plurality of heads is disposed between any adjacent two of the plurality of rows.

11. The ink jet recording apparatus according to claim 1, wherein the second control portion is configured to control the relative movement mechanism to prevent the conveyor mechanism and the ink-jet head from moving relatively toward each other when the sensor detects the recording medium during the second operation before the conveyor mechanism and the ink jet head are located at the recording position.

12. An ink jet recording apparatus, comprising:

an ink-jet head in which is formed an ejection surface from which ink is ejected;

a conveyor mechanism which has a conveyor surface opposed to the ejection surface and which is configured to convey a recording medium placed on the conveyor surface, in a medium conveyance direction;

a relative movement mechanism configured to move at least one of the conveyor mechanism and the ink-jet head relative to each other such that the conveyor mechanism and the ink jet head are located selectively at one of: a recording position at which an image is recorded on the recording medium with the ink ejected from the ink-jet head; and a medium removal position at which a distance between the ejection surface and the conveyor mechanism is larger than that when the conveyor mechanism and the ink jet head are located at the recording position and at which a jammed recording medium jammed between the ejection surface and the conveyor mechanism is allowed to be removed by a user;

a detecting device configured to detect an occurrence of a jam of the recording medium between the ink jet head and the conveyor mechanism;

an output device configured to output a jam-clearing completion signal indicative of completion of a jam-clearing processing for clearing the jam of the recording medium, in response to a prescribed operation by a user;

a sensor for detecting the recording medium existing between the ink jet head and the conveyor mechanism; and a relative-movement control device configured to control the relative movement mechanism and including (a) a first control portion configured to control the relative movement mechanism such that the relative movement mechanism conducts a first operation in which said at least one of the conveyor mechanism and the ink-jet head is moved relative to each other such that the conveyor mechanism and the ink jet head are located at the medium removal position from the recording position when the detecting device detects the occurrence of the jam of the recording medium and such that the relative movement mechanism conducts, after the first operation, a second operation in which said at least one of the conveyor mechanism and the ink-jet head is moved relative to each other such that the conveyor mechanism and the ink-jet head are located at the recording position from the medium removal position when the output device outputs the jam-clearing completion signal and (b) a second control portion configured to control the sensor to start detecting the recording medium existing between the ink jet head and the conveyor mechanism after the jam-completion signal has been output and before the second operation is conducted and to control the relative movement mechanism to prevent the conveyor mechanism and the ink jet head from moving relatively toward each other when the sensor detects the recording medium in the second operation, wherein the conveyor mechanism includes an adhesion device configured to cause the recording medium to adhere to the conveyor surface, and wherein the ink jet recording apparatus further comprises an adhesion control device configured to control the adhesion device to be placed in its operating state during the second operation.

* * * * *